US008013278B2

(12) United States Patent
Kurono et al.

(10) Patent No.: US 8,013,278 B2
(45) Date of Patent: Sep. 6, 2011

(54) CERAMIC HEATER AND GLOW PLUG

(75) Inventors: Hirokazu Kurono, Nagoya (JP); Hiroshi Nishihara, Nagoya (JP); Kazuya Matsui, Nagoya (JP); Masahiro Konishi, Nagoya (JP)

(73) Assignee: NGK Spark Plug Co., Ltd., Aichi (JP)

( * ) Notice: Subject to any disclaimer, the term of this patent is extended or adjusted under 35 U.S.C. 154(b) by 518 days.

(21) Appl. No.: 12/160,250

(22) PCT Filed: Mar. 20, 2007

(86) PCT No.: PCT/JP2007/055754

§ 371 (c)(1),
(2), (4) Date: Jul. 8, 2008

(87) PCT Pub. No.: WO2007/108491

PCT Pub. Date: Sep. 27, 2007

(65) Prior Publication Data

US 2009/0008383 A1 Jan. 8, 2009

(30) Foreign Application Priority Data

Mar. 21, 2006 (JP) ..... 2006-077867

(51) Int. Cl.
*H05B 3/10* (2006.01)
*F23Q 7/22* (2006.01)

(52) U.S. Cl. ..... 219/552

(58) Field of Classification Search ..... 219/552–553, 219/270, 267, 538, 539, 542, 544
See application file for complete search history.

(56) References Cited

U.S. PATENT DOCUMENTS

2006/0011602 A1 1/2006 Konishi et al.

FOREIGN PATENT DOCUMENTS

| | | | |
|---|---|---|---|
| JP | 02-20293 | * | 2/1990 |
| JP | 2-20293 U | | 2/1990 |
| JP | 02-020293 U | | 2/1990 |
| JP | 2002-203665 A | | 7/2002 |
| JP | 2002-220285 A | | 8/2002 |
| JP | 2002-289327 A | | 10/2002 |
| JP | 2005-300046 A | | 10/2005 |
| JP | 2006-024394 | * | 1/2006 |
| JP | 2006-024394 A | | 1/2006 |
| JP | 2006-049279 A | | 2/2006 |

* cited by examiner

*Primary Examiner* — Shawntina Fuqua
(74) *Attorney, Agent, or Firm* — Sughrue Mion, PLLC

(57) ABSTRACT

There are provided a ceramic heater in which a defect, such as generation of a gap at the interface between an insulating substrate and a heat-generating resistor, is unlikely to occur in the course of manufacture or use, and a glow plug using the ceramic heater. A ceramic heater 110 includes an insulating substrate 111 extending in the direction of an axis AX and a heat-generating resistor 115, which has a heat-generating portion 116, two lead portions 117, 117 and two lead lead-out portions 118*a* and 118*b*. The ceramic heater 110 satisfies an expression S1≦0.34 Sa, where Sa is the area of a cross section of the ceramic heater 110 taken perpendicular to the direction of the axis AX, and S1 is the total cross-sectional area of the two lead portions 117, 117 as measured in the cross section.

13 Claims, 6 Drawing Sheets

CERAMIC HEATER AND GLOW PLUG

TECHNICAL FIELD

The present invention relates to a ceramic heater which is used in an ignition source such as a glow plug and to a glow plug using the ceramic heater.

BACKGROUND ART

Regarding demand for glow plugs used to preheat diesel engines, recently, there has been increasing demand for glow plugs capable of quickly raising temperature. Glow plugs are required to exhibit, for example, such a temperature rise performance as to reach 1,000° C. in about two to three seconds at an applied voltage of 11 V. In order to satisfy such a requirement, in Patent Documents 1 to 3, for example, a silicon-nitride-tungsten-carbide composite sintered body, which is a conductive ceramic, is used to form a heat-generating resistor whose end portion (heat-generating portion) exhibits high resistance and whose lead portions exhibit low resistance.

Patent Document 1: Japanese Patent Application Laid-Open (kokai) No. 2002-203665

Patent Document 2: Japanese Patent Application Laid-Open (kokai) No. 2002-220285

Patent Document 3: Japanese Patent Application Laid-Open (kokai) No. 2002-289327

DISCLOSURE OF THE INVENTION

Problems to be Solved by the Invention

However, for example, when, as described in Patent Document 2, the tungsten carbide content of a silicon-nitride-tungsten-carbide composite sintered body is increased for lowering resistance, the thermal expansion coefficient of the heat-generating resistor formed from the silicon-nitride-tungsten-carbide composite sintered body also increases in proportion to the tungsten carbide content. This increases a difference in thermal expansion coefficient between the heat-generating resistor and an insulating substrate formed from a silicon nitride sintered body. As a result, in the course of manufacture or use, high thermal stress arises. This is apt to raise a defect, such as generation of a gap at the interface between the heat-generating resistor and the insulating substrate.

In order to achieve quick temperature rise, the heat-generating resistor has such a structure that a heat-generating portion located at its end is made thin, whereas its lead portions are made thick. Accordingly, high thermal stress is imposed on the large-diameter lead portions in the course of manufacture or use. This is apt to raise a defect, such as generation of a gap at the interface between the heat-generating resistor and the insulating substrate. In an all-ceramic heater whose lead portions are of a conductive ceramic, the conductive ceramic is used in place of a tungsten lead wire to form the lead portions. Thus, as compared with a heater which uses a tungsten lead wire, the overall length of the heat-generating resistor becomes longer. This is apt to increase thermal stress which is imposed on the heat-generating resistor in the course of manufacture or use.

The present invention has been accomplished in view of the above-mentioned present situation, and an object of the invention is to provide a ceramic heater in which a defect, such as generation of a gap at the interface between a heat-generating resistor and an insulating substrate, is unlikely to occur in the course of manufacture or use, as well as a glow plug which uses the ceramic heater and exhibits high reliability.

Means for Solving the Problems

Means of solution is a ceramic heater extending in an axial direction and adapted to generate heat from its front end portion upon energization, the ceramic heater comprising an insulating substrate formed from an insulating ceramic and extending in the axial direction, and a heat-generating resistor formed from a conductive ceramic and embedded in the insulating substrate. In the ceramic heater, the heat-generating resistor comprises a heat-generating portion embedded in a front end portion of the insulating substrate, having such a form as to extend frontward from a rear side, change direction, and then again extend rearward, and generating heat upon energization; a pair of lead portions connected to respective rear ends of the heat-generating portion and extending rearward in the axial direction; and a pair of lead lead-out portions connected to the respective lead portions, extending radially outward, and exposed outward. The ceramic heater satisfies an expression $S1 \leqq 0.34$ Sa in any cross section of the ceramic heater which is taken perpendicular to the axial direction and in which the lead portions are present, where Sa is a cross-sectional area of the ceramic heater, and S1 is a total cross-sectional area of the pair of lead portions.

The insulating substrate formed from an insulating ceramic, and the heat-generating resistor formed from a conductive ceramic differ in thermal expansion coefficient; thus, thermal stress arises in the course of manufacture or use of a ceramic heater. This is apt to raise a defect, such as generation of a gap at the interface between the insulating substrate and the heat-generating resistor.

By contrast, in the present invention, the total cross-sectional area S1 of the pair of lead portions is reduced so as to satisfy the expression $S1 \leqq 0.34$ Sa, where Sa is the cross-sectional area of the ceramic heater. Employment of the total cross-sectional area S1 of the lead portions which satisfies the relation lowers stress which is imposed on the interface between the insulating substrate and the heat-generating resistor (lead portions) in the course of manufacture or use. Accordingly, at the interface between the insulating substrate and each of the lead portions, a defect, such as generation of a gap therebetween, becomes less likely to occur than in a conventional practice.

No particular limitation is imposed on the material for the "heat-generating resistor," so long as a conductive ceramic is used. A typical conductive ceramic contains a conductive component and an insulating component. Examples of such a conductive component include a silicide, a carbide, and a nitride of one or more metal elements selected from among W, Ta, Nb, Ti, Mo, Zr, Hf, V, Cr, etc. An example of such an insulating component is silicon nitride.

No particular limitation is imposed on the material for the "insulating substrate," so long as an insulating ceramic is used. A typical insulating ceramic is a silicon nitride sintered body. The silicon nitride sintered body may contain silicon nitride only or may contain a predominant amount of silicon nitride and a small amount of aluminum nitride, alumina, etc.

Preferably, the ceramic heater mentioned above satisfies an expression $S1 \leqq 0.25$ Sa.

In the present invention, the total cross-sectional area S1 of the lead portions is further reduced so as to satisfy the expression $S1 \leqq 0.25$ Sa. Employment of the total cross-sectional area S1 of the lead portions which satisfies the relation particularly lowers stress which is imposed on the interface between the insulating substrate and the heat-generating resistor (lead portions) in the course of manufacture or use. Accordingly, a defect, such as generation of a gap at the interface between the insulating substrate and each of the lead portions, can be prevented with particular effectiveness.

Preferably, any one of the ceramic heaters mentioned above further satisfies an expression $S1 \geqq 0.15$ Sa.

In order to lower stress imposed on the interface between the insulating substrate and the heat-generating resistor, as mentioned above, lowering S1, specifically to 0.34 Sa or less, further to 0.25 Sa or less, is desirable.

On the other hand, in the present invention, S1 is 0.15 Sa or greater. When S1 is less than 0.15 Sa, the lead portions of the heat-generating resistor become excessively thin. This lowers strength of the heat-generating resistor (lead portions) itself, increasing the risk of occurrence of crack or the like.

Preferably, any one of the ceramic heaters mentioned above further satisfies an expression $S2 \leqq 0.16$ Sb in at least any cross section of the ceramic heater which is taken perpendicular to the axial direction and in which the heat-generating portion is present, where Sb is a cross-sectional area of the ceramic heater, and S2 is a cross-sectional area of the heat-generating portion.

According to the present invention, in at least any cross section of the ceramic heater, the cross-sectional area S2 of the heat-generating portion is reduced so as to satisfy the expression $S2 \leqq 0.16$ Sb. Reducing the cross-sectional area S2 of the heat-generating portion in this manner increases resistance of the heat-generating portion, thereby implementing a high-performance ceramic heater capable of quickly raising temperature.

Preferably, the ceramic heater mentioned above satisfies an expression $S2 \leqq 0.08$ Sb.

In the present invention, the cross-sectional area S2 of the heat-generating portion is further reduced so as to satisfy the expression $S2 \leqq 0.08$ Sb. Reducing the cross-sectional area S2 of the heat-generating portion in this manner further increases resistance of the heat-generating portion, thereby implementing a high-performance ceramic heater capable of more quickly raising temperature.

Preferably, any one of the ceramic heaters mentioned above exhibits the following features. A cross section of the ceramic heater which is taken perpendicular to the axial direction assumes a circular form, an elliptical form, or an oblong form. In any cross section of the ceramic heater which is taken perpendicular to the axial direction and in which the lead portions are present, of imaginary straight lines which pass through the center of the cross section and along which a gap between the lead portions is measured, an imaginary straight line associated with a minimum gap is defined as a minimum-gap-associated imaginary straight line. Of intersections of the minimum-gap-associated imaginary straight line and an outline of one of the lead portions, an intersection located on a side toward the center is defined as a point A. Of intersections of the minimum-gap-associated imaginary straight line and an outline of the other one of the lead portions, an intersection located on a side toward the center is defined as a point E. Intersections of the outline of the one lead portion and an imaginary circle drawn with the center of the cross section as a center of the imaginary circle and with half of a major diameter of the cross section as a diameter of the imaginary circle are defined as a point B and a point C. Intersections of the outline of the other lead portion and the imaginary circle are defined as a point F and a point G. An angle $\alpha$ formed by a line segment AB and a line segment AC, and an angle $\beta$ formed by a line segment EF and a line segment EG both range from 160 degrees to 175 degrees.

When the angle $\alpha$ formed by the line segments AB and AC or the angle $\beta$ formed by the line segments EF and EG is less than 160 degrees, stress is apt to concentrate particularly in the vicinity of the points A and E at the interface between the insulating substrate and the heat-generating resistor (lead portions) in the course of manufacture or use. Thus, in the vicinity of the points A and E, a defect, such as generation of a gap at the interface between the heat-generating resistor and the insulating substrate, is apt to occur.

When the angle $\alpha$ formed by the line segments AB and AC or the angle $\beta$ formed by the line segments EF and EG is in excess of 175 degrees, in a process of injection-molding a green heat-generating resistor, difficulty may be encountered in removal of the green heat-generating resistor from a mold.

By contrast, in the present invention, the angle $\alpha$ formed by the line segments AB and AC and the angle $\beta$ formed by the line segments EF and EG are 160 degrees or greater, thereby restraining concentration of stress in the vicinity of the points A and E. Accordingly, a defect, such as generation of a gap at the interface between the insulating substrate and each of the lead portions; particularly, in the vicinity of the points A and E, can be effectively prevented.

Since the angle $\alpha$ formed by the line segments AB and AC and the angle $\beta$ formed by the line segments EF and EG are 175 degrees or less, in a process of injection-molding a green heat-generating resistor, the green heat-generating resistor can be reliably removed from a mold.

Preferably, in any one of the ceramic heaters mentioned above, an overall length L of the heat-generating resistor along the axial direction is 30 mm or greater.

As mentioned previously, as compared with a heater which uses a tungsten lead wire, an all-ceramic heater whose lead portions are of a conductive ceramic tends to become longer in the overall length L of the heat-generating resistor. Accordingly, in the course of manufacture or use, the difference in thermal expansion along the axial direction between the insulating substrate and the heat-generating resistor increases. Thus, thermal stress which arises in the course of manufacture or use is apt to increase. Therefore, a defect, such as generation of a gap at the interface between the insulating substrate and the heat-generating resistor, is apt to occur. Such a defect is apt to occur particularly when the heat-generating resistor has an overall length L of 30 mm or greater.

By contrast, in the present invention, as mentioned previously, the total cross-sectional area S1 of the lead portions is reduced so as to satisfy the expression $S1 \leqq 0.34$ Sa, thereby lowering stress which is imposed on the interface between the insulating substrate and each of the lead portions in the course of manufacture or use. Therefore, even though the heat-generating resistor has an overall length L of 30 mm or greater, a defect, such as generation of a gap at the interface between the insulating substrate and each of the lead portions, is unlikely to occur.

Preferably, in any one of the ceramic heaters mentioned above, the pair of lead lead-out portions are arranged with a gap K of 5 mm or greater therebetween along the axial direction.

If the lead lead-out portions formed from a conductive ceramic are arranged close to each other, the percentage of the conductive ceramic increases in the vicinity of the lead lead-out portions, thereby increasing thermal stress which arises in the course of manufacture or use. As a result, in the vicinity of the lead lead-out portions, a defect, such as generation of a gap at the interface between the insulating substrate and the heat-generating resistor, is apt to occur.

By contrast, in the present invention, the paired lead lead-out portions are arranged with a gap K of 5 mm or greater therebetween, thereby lowering thermal stress which arises in the vicinity of the lead lead-out portions in the course of manufacture or use. Therefore, a defect, such as generation of a gap at the interface between the insulating substrate and the heat-generating resistor, can be restrained.

Preferably, in any one of the ceramic heaters mentioned above, the insulating substrate is formed from a silicon nitride sintered body, and the heat-generating resistor is formed from a silicon-nitride-tungsten-carbide composite sintered body.

The insulating substrate formed from a silicon nitride sintered body, and the heat-generating resistor formed from a silicon-nitride-tungsten-carbide composite sintered body differ greatly in thermal expansion coefficient; thus, thermal stress arises in the course of manufacture or use of a ceramic heater. Therefore, a defect, such as generation of a gap at the interface between the insulating substrate and the heat-generating resistor, is particularly apt to occur.

By contrast, in the present invention, as mentioned previously, the total cross-sectional area S1 of the lead portions is reduced so as to satisfy the expression $S1 \leqq 0.34$ Sa, thereby lowering stress which is imposed on the interfaces between the insulating substrate and each of the lead portions in the course of manufacture or use. Therefore, even though the insulating substrate is formed from a silicon nitride sintered body, and the heat-generating resistor is formed from a silicon-nitride-tungsten-carbide composite sintered body, a defect, such as generation of a gap at the interface between the insulating substrate and the heat-generating resistor, becomes unlikely to occur.

The "silicon nitride sintered body" may contain silicon nitride only or may contain a predominant amount of silicon nitride and a small amount of aluminum nitride, alumina, etc.

Preferably, in the ceramic heater mentioned above, silicon nitride grains contained in the heat-generating resistor have an average grain size of 0.5 μm to 0.8 μm.

According to the present invention, silicon nitride grains contained in the heat-generating resistor have an average grain size of 0.5 μm to 0.8 μm. The silicon nitride grains assume the form of needle-like crystals and are, so to speak, long and thin crystal grains. When the average grain size is large to a certain extent; i.e., when grains are long and thin, the degree of overlapping of grains increases, and thus enhancement of mechanical strength can be expected. Therefore, the average grain size is desirably 0.5 μm or greater. When the average grain size is less than 0.5 μm, the mechanical strength may become insufficient. Meanwhile, the average grain size is desirably 0.8 μm or less. When the grain size is excessively large; for example, in excess of 0.8 μm, bond strength between silicon nitride grains lowers, and thus sufficient strength may fail to be obtained. Therefore, employment of an average grain size of 0.5 μm to 0.8 μm can further restrain a defect, such as generation of a gap at the interface between the insulating substrate and the heat-generating resistor.

Notably, the "average grain size" in the present invention is obtained as follows. The cross section of the ceramic heater is mirror-polished, followed by etching. Subsequently, the etched surface is photoed through SEM to obtain a 5,000-magnification SEM image (a visual field of approx. 16 μm×approx. 26 μm). About 20 straight lines are drawn on the image, and the number of silicon nitride grains intersecting with a single straight line is counted. The "average grain size" is obtained as (length of straight line)/(number of grains)=(average grain size).

The above mentioned defect is apt to occur particularly when the difference in thermal expansion coefficient at room temperature between the insulating substrate and the heat-generating resistor is 0.6 ppm/° C. or greater. Also, as the cross-sectional area of the lead portions increases, tendency toward occurrence of the defect increases.

Preferably, any one of the ceramic heaters mentioned above satisfies an expression $a \geqq 0.15(b+c)$ in any cross section of the ceramic heater which is taken perpendicular to the axial direction and in which the lead portions are present, where of imaginary straight lines which pass through the center of the cross section and along which a gap a between the lead portions is measured, an imaginary straight line associated with a minimum gap a is defined as a minimum-gap-associated imaginary straight line; and b and c are dimensions of the respective lead portions as measured on the minimum-gap-associated imaginary straight line.

As mentioned previously, an insulating ceramic and a conductive ceramic differ in thermal expansion coefficient; thus, thermal stress arises in the course of manufacture or use of a ceramic heater. This is apt to raise a defect, such as generation of a gap at the interface between the heat-generating resistor and the insulating substrate. Such a defect is apt to occur particularly at the interface between each of the paired lead portions and a portion of the insulating substrate intervening between the paired lead portions, for the following reason. Since the thermal expansion coefficient of the lead portions is greater than that of the insulating substrate, when temperature drops after firing or after use, the lead portions shrink to a greater extent than the insulating substrate. Conceivably, at that time, a portion of the insulating substrate intervening between the lead portions is pulled in opposite lateral directions by the lead portions; as a result, the portion is subjected to a greater stress than is the other portion.

By contrast, in the present invention, of imaginary straight lines which pass through the center of the cross section of the ceramic heater and along which a gap a between the lead portions is measured, an imaginary straight line associated with a minimum gap a is defined as the minimum-gap-associated imaginary straight line, and dimensions of the respective lead portions as measured on the minimum-gap-associated imaginary straight line are taken as b and c. The gap a is increased so as to satisfy the expression $a \geqq 0.15(b+c)$. Employment of the gap a between the lead portions which satisfies the relation reduces stress which is imposed on a portion of the insulating substrate intervening between the lead portions in the course of manufacture or use. Therefore, at the interface between each of the lead portions and a portion of the insulating substrate intervening between the lead portions, a defect, such as generation of a gap therebetween, becomes less likely to occur than in a conventional practice.

No particular limitation is imposed on the form of "a pair of lead portions," so long as the lead portions are connected to respective rear ends of the heat-generating portion and extend rearward along the axial direction. However, preferably, as viewed in the cross section of the ceramic heater which is taken perpendicular to the axial direction, the lead portions are symmetrical to each other with respect to a straight line including the center of the ceramic heater (insulating substrate), while facing each other. This renders generated stress symmetrical, so that the ceramic heater becomes unlikely to suffer distortion or like deformation. Preferably, "a pair of lead portions" has such a shape that, in the cross section of the ceramic heater perpendicular to the axial direction, the dimensions b and c of the respective lead portions as measured on the minimum-gap-associated imaginary straight line are smaller than dimensions of the lead portions as measured along a direction perpendicular to the minimum-gap-associated imaginary straight line. Examples of a specific shape of the cross section of each of the lead portions which is taken perpendicular to the axial direction include elliptic and oblong shapes whose minor diameter corresponds to the dimension b or c, and a bow shape whose chord faces that of the other bow shape.

Preferably, in any one of the ceramic heaters mentioned above, a cross section of the ceramic heater which is taken perpendicular to the axial direction assumes a circular form, and the ceramic heater satisfies $2 \leqq D \leqq 10$ and an expression $a \leqq D-(b+c)-0.2$, where D (mm) is a diameter of any cross section of the ceramic heater which is taken perpendicular to the axial direction and in which the lead portions are present; of imaginary straight lines which pass through the center of the cross section and along which a gap a (mm) between the lead portions is measured, an imaginary straight line associated with a minimum gap a (mm) is defined as a minimum-gap-associated imaginary straight line; and b (mm) and c (mm) are dimensions of the respective lead portions as measured on the minimum-gap-associated imaginary straight line.

As mentioned previously, an insulating ceramic and a conductive ceramic differ in thermal expansion coefficient; thus, thermal stress arises in the course of manufacture or use of a ceramic heater. This is apt to raise a defect, such as generation of a gap between the heat-generating resistor and the insulating substrate. Such a defect is apt to occur also at the interface between each of the lead portions and a portion of the insulating substrate which is located radially outward of the lead portion and covers the lead portion. Therefore, portions of the insulating substrate which cover the respective lead portions from the radially outside of the lead portions must have a sufficient thickness to restrain occurrence of a defect such as crack. Specifically, in a ceramic heater whose cross section taken perpendicular to the axial direction has a circular form and whose insulating substrate has a diameter D of 2 mm to 10 mm, a portion of the insulating substrate located radially outward of each of the paired lead portions must have a thickness of 0.1 mm or greater (a total of both sides of 0.2 mm or greater).

By contrast, in the present invention, the diameter of the insulating substrate is taken as D (mm); of imaginary straight lines which pass through the center of the cross section of the ceramic heater and along which a gap a (mm) between the lead portions is measured, an imaginary straight line associated with a minimum gap a (mm) is defined as the minimum-gap-associated imaginary straight line; and dimensions of the respective lead portions as measured on the minimum-gap-associated imaginary straight line are taken as b (mm) and c (mm). The gap a is reduced so as to satisfy the expression $a \leqq D-(b+c)-0.2$. Through employment of the gap a between the lead portions satisfying the relation, the insulating substrate can be such that its portions located radially outward of the respective lead portions each have a thickness of 0.1 mm or greater (a total of 0.2 mm or greater). Therefore, in the course of manufacture or use, at the interfaces between the lead portions and the respective portions of the insulating substrate which cover the respective lead portions from the radially outside of the lead portions, a defect, such as generation of a gap therebetween, becomes less likely to occur than in a conventional practice.

Preferably, the ceramic heater mentioned above further satisfies an expression $a \geqq 0.15(b+c)$.

As mentioned previously, in the course of manufacture or use, also at the interface between each of the paired lead portions and a portion of the insulating substrate intervening between the paired lead portions, a defect, such as generation of a gap therebetween, is also apt to occur.

By contrast, in the present invention, the gap a between the lead portions is increased so as to satisfy the expression $a \geqq 0.15(b+c)$. Satisfaction of the relation lowers stress which is imposed on a portion of the insulating substrate intervening between the lead portions in the course of manufacture or use. Therefore, not only at the above-mentioned interface between each of the lead portions and a portion of the insulating substrate which covers the lead portion from the radially outside of the lead portion, but also at the interface between each of the lead portions and a portion of the insulating substrate intervening between the lead portions, a defect, such as generation of a gap, becomes less likely to occur than in a conventional practice.

Another means of solution is a glow plug comprising any one of the ceramic heaters mentioned above.

The glow plug of the present invention uses a ceramic heater in which a defect, such as generation of a gap at the interface between the insulating substrate and the heat-generating resistor, is unlikely to occur in the course of manufacture or use, and thus can exhibit high reliability.

DESCRIPTION OF REFERENCE NUMERALS

Figure 1:
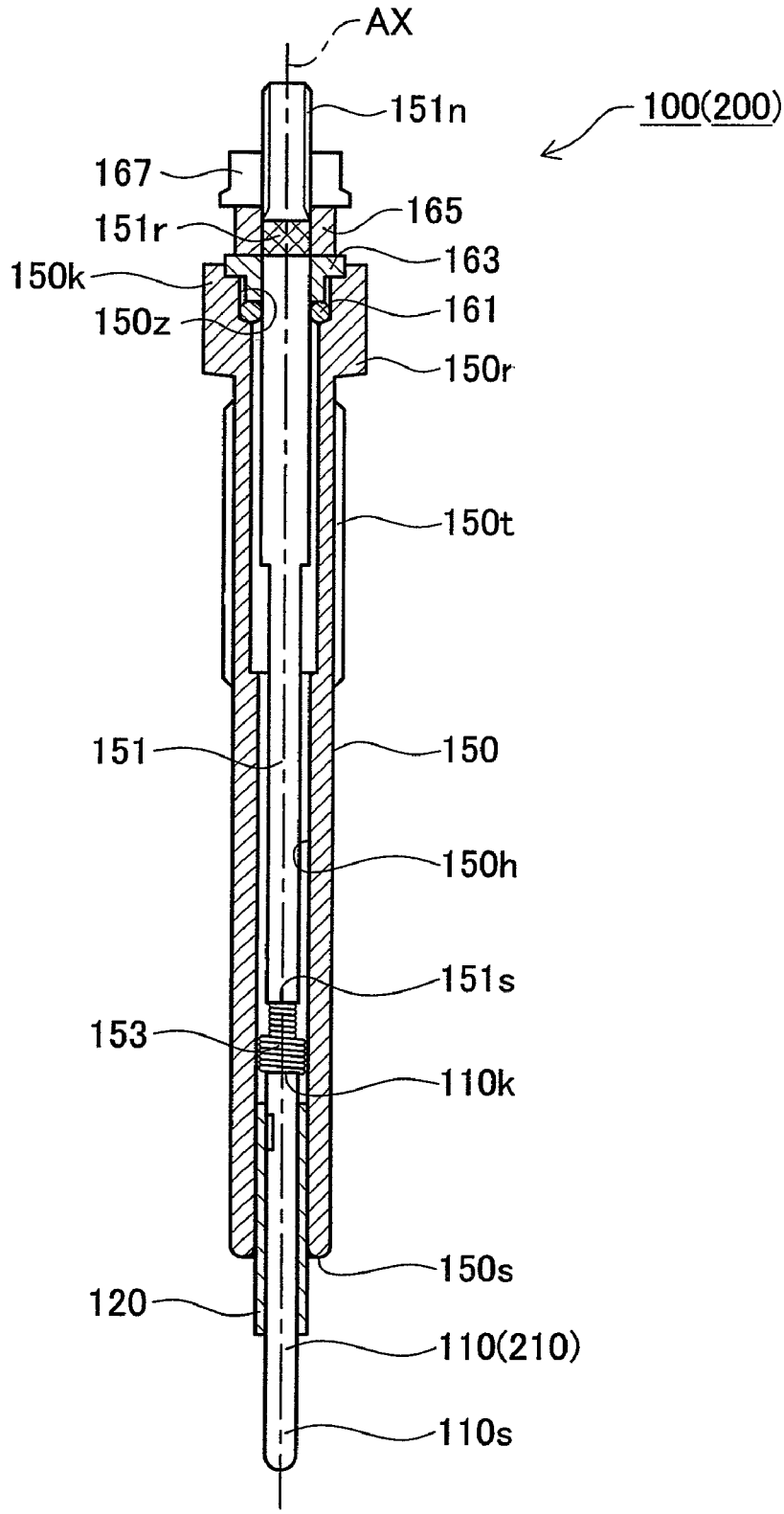
[FIG. 1] Longitudinal sectional view of a glow plug according to Embodiment 1.

100, 200: glow plug
110, 210: ceramic heater
110*s*: front end portion (of ceramic heater)
110 *k*: rear end portion (of ceramic heater)
111, 211: insulating substrate
111*s*: front end portion (of insulating substrate)
115: heat-generating resistor
116: heat-generating portion
116*k*: rear end (of heat-generating portion)
117, 217: lead portion
118*a*, 118*b*: lead lead-out portion
120: fixing tube
150: metallic shell
151: energization terminal
AX: axis
L: overall length (along axial direction of heat-generating resistor)
K: gap (between lead lead-out portions along axial direction)
D: diameter of insulating substrate
g: center
kl: minimum-gap-associated imaginary straight line
a: gap (between lead portions)
b, c: dimension (of lead portion along direction of juxtaposition of lead portions)

d, e: thickness (of portions of insulating substrate covering lead portions from radially outside)

BEST MODE FOR CARRYING OUT THE INVENTION

Embodiment 1

Figure 2:
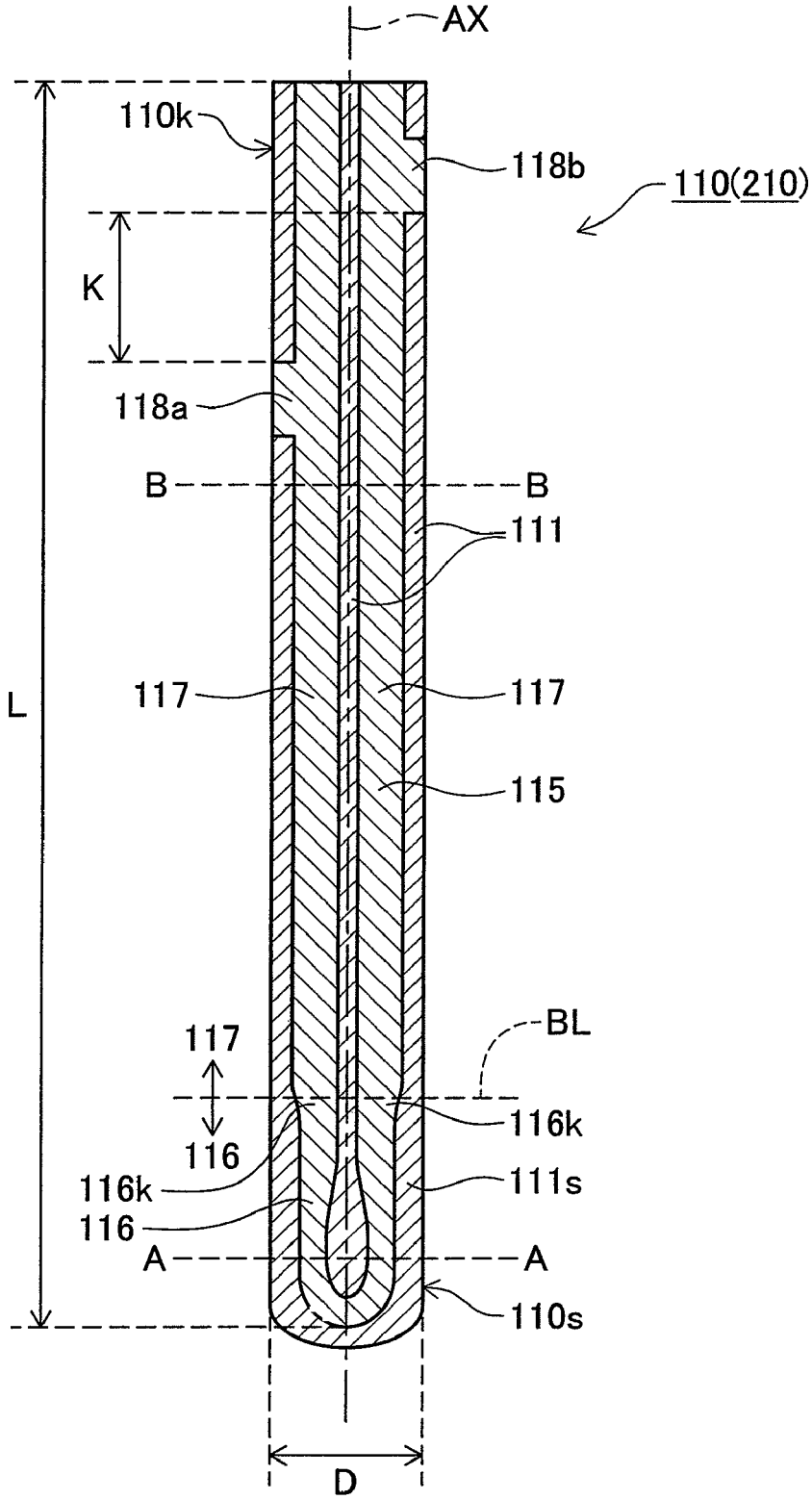
[FIG. 2] Longitudinal sectional view of a ceramic heater according to Embodiment 1.
Figure 3:
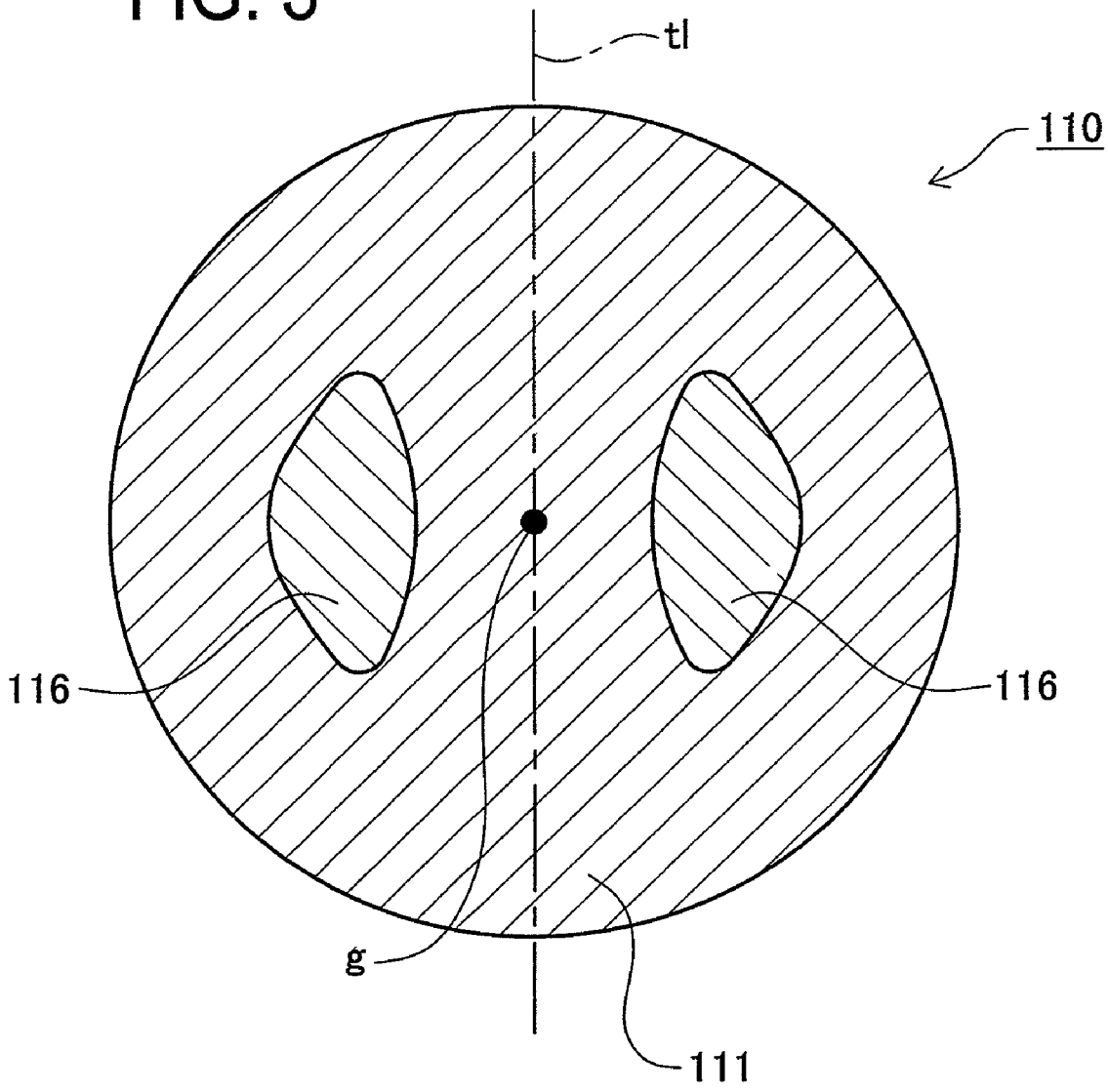
[FIG. 3] Cross-sectional view of the ceramic heater according to Embodiment 1 taken along line A-A of FIG. 2.
Figure 4:
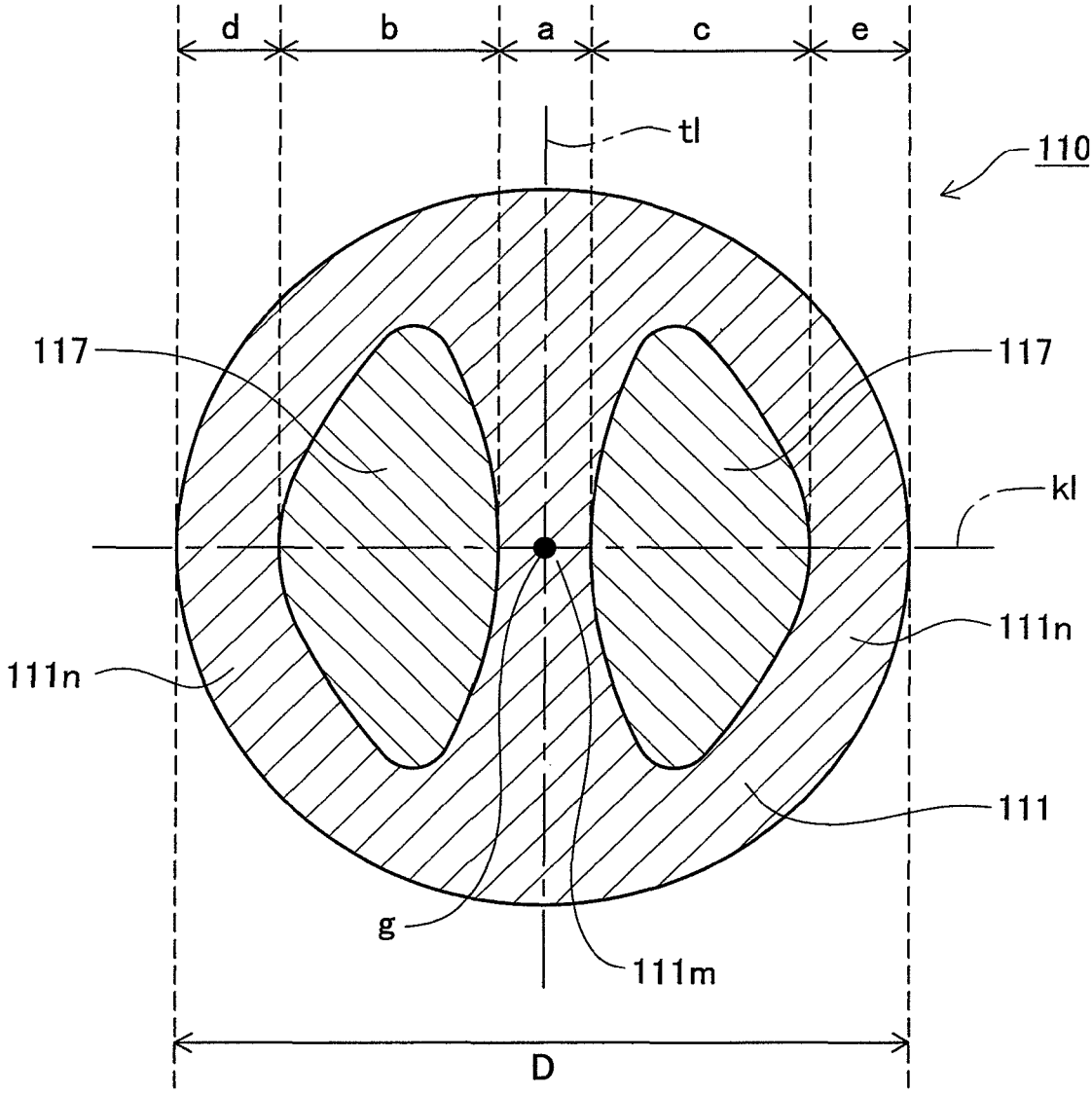
[FIG. 4] Cross-sectional view of the ceramic heater according to Embodiment 1 taken along line B-B of FIG. 2.
Figure 5:
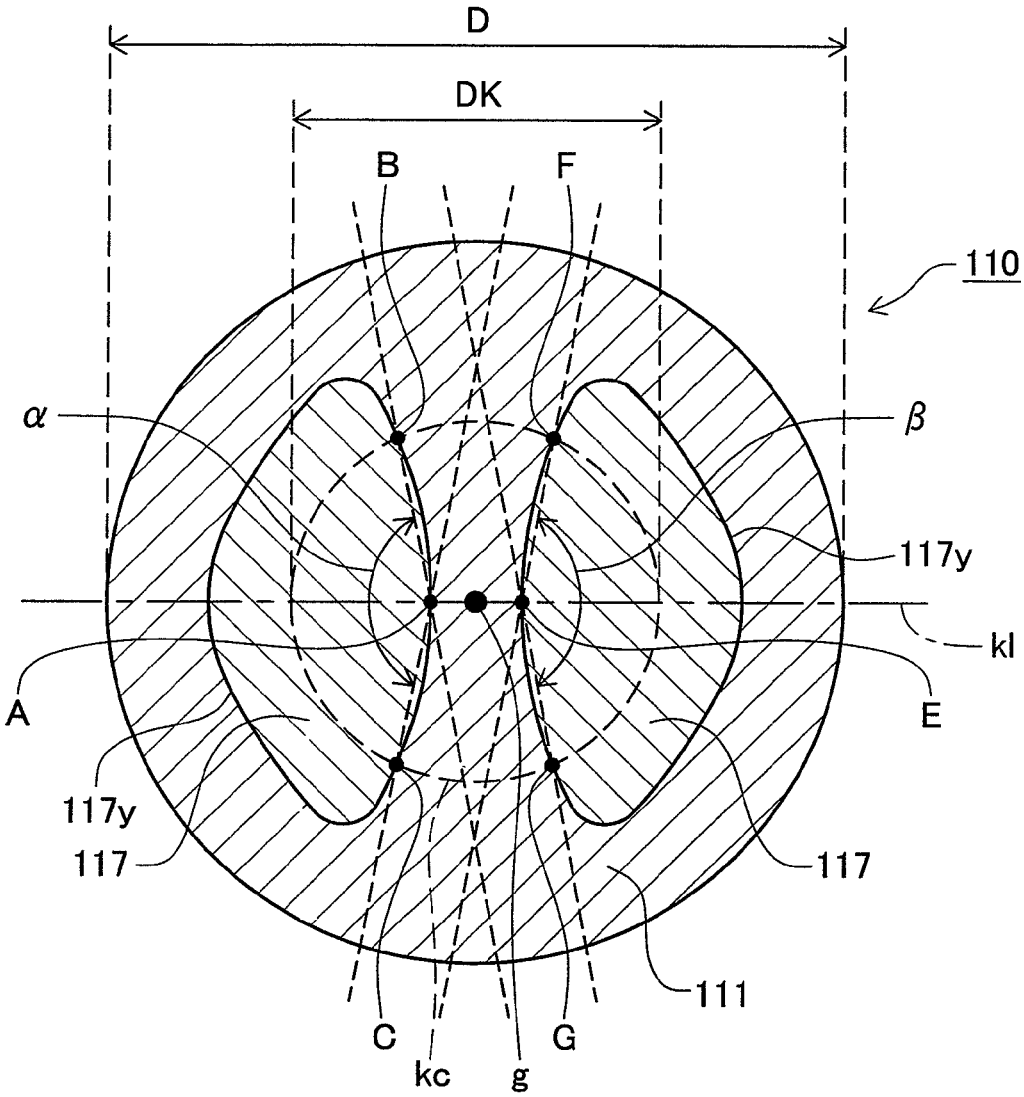
[FIG. 5] Cross-sectional view of the ceramic heater according to Embodiment 1 taken along line B-B of FIG. 2, showing an angle $\alpha$ formed by a line segment AB and a line segment AC, and an angle $\beta$ formed by a line segment EF and a line segment EG.

Embodiments of the present invention will next be described with reference to the drawings. FIG. 1 is a longitudinal sectional view of a glow plug 100 according to Embodiment 1. FIG. 2 is a longitudinal sectional view of a ceramic heater 110 according to Embodiment 1. FIG. 3 is a cross-sectional view of the ceramic heater 110 which is taken perpendicular to the direction of an axis AX and in which a heat-generating portion 116 is present (cross-sectional view taken along line A-A of FIG. 2). FIGS. 4 and 5 are cross-sectional views of the ceramic heater 110 which are taken perpendicular to the direction of the axis AX and in which lead portions 117, 117 are present (cross-sectional view taken along line B-B of FIG. 2).

The glow plug 100 includes a ceramic heater 110 formed from ceramic and extending in the direction of the axis AX, and a tubular metallic shell 150 which covers and holds a rear end portion of the ceramic heater 110. As will be described later, the ceramic heater 110 is designed such that, in the course of use, a defect, such as generation of a gap at the interface between a heat-generating resistor 115 and an insulating substrate 111 is unlikely to occur; therefore, the glow plug 100 exhibits high reliability.

The ceramic heater 110 is held in a through-hole 150*h* of the metallic shell 150 via a fixing tube 120 in such a manner that a front end portion 110*s*, which generates heat upon energization, projects from a front end portion 150*s* of the metallic shell 150. As shown in FIG. 2, the ceramic heater 110 has the insulating substrate 111 and the heat-generating resistor 115. The insulating substrate 111 extends in the direction of the axis AX and assumes a columnar form, and its front end (lower end in FIG. 2) is rounded to a hemispheric form. The heat-generating resistor 115 is embedded in the insulating substrate 111 along the direction of the axis AX.

The insulating substrate 111 is formed from a silicon nitride sintered body, which is an insulating ceramic, and has a diameter D of 3.3 mm and a length of 42 mm along the direction of the axis AX. The insulating substrate 111 has a thermal expansion coefficient of 3.2 ppm/° C. at room temperature.

The heat-generating resistor 115 is formed from a silicon-nitride-tungsten-carbide composite sintered body, which is a conductive ceramic, and includes a heat-generating portion 116, a pair of the lead portions 117, 117, and a pair of lead lead-out portions 118*a*, 118*b*. The heat-generating resistor 115 has an overall length L of 30 mm or greater (specifically, the overall length L is 40.0 mm) along the direction of the axis AX. Silicon nitride grains contained in the heat-generating resistor 115 have an average grain size of 0.5 μm to 0.8 μm (specifically 0.6 μm). The heat-generating resistor 115 has a thermal expansion coefficient of 3.8 ppm/° C. at room temperature. Thus, the difference in thermal expansion coefficient at room temperature between the insulating substrate 111 and the heat-generating resistor 115 is 0.6 ppm/° C. or greater (specifically, 0.6 ppm/° C.).

The heat-generating portion 116 of the heat-generating resistor 115 is embedded in a front end portion 111*s* of the insulating substrate 111 and has such a form as to extend frontward (downward in FIG. 2) from the rear side (upper side in FIG. 2), change direction, and then again extend rearward. The heat-generating portion 116 is formed thick (large in cross-sectional area) at its portions in the vicinity of rear ends 116*k*, 116*k* continuous with the respective lead portions 117, 117, which will be described later. The other portion of the heat-generating portion 116 is formed thinner (smaller in cross-sectional area) than the lead portions 117, 117 while having the same thickness, so as to achieve high resistance. As is apparent from FIG. 3, which shows a cross section taken along line A-A of FIG. 2 (cross section perpendicular to the direction of the axis AX), portions of the heat-generating portion 116 which extend in the direction of the axis AX each have a generally elliptical cross section, and face each other symmetrically with respect to an imaginary straight line tl including a center g of the insulating substrate 111. The heat-generating portion 116 is a portion of the heat-generating resistor 115 which is formed thinner (smaller in cross-sectional area) than the lead portions 117, 117 to be described later, so as to achieve high resistance, and which is located frontward of a broken line BL in FIG. 2.

The ceramic heater 110 shown in FIG. 3 has an entire cross-sectional area Sb of 8.55 $mm^2$. A total cross-sectional area S2 of the heat-generating portion 116 is 0.67 $mm^2$. Therefore, the ceramic heater 110 exhibits S2=0.078 Sb, so that the ceramic heater 110 satisfies an expression S2≦0.16 Sb and further satisfies an expression S2≦0.08 Sb. Reducing the cross-sectional area S2 of the heat-generating portion 116 in this manner increases resistance of the heat-generating portion 116. Therefore, the ceramic heater 110 can be a high-performance ceramic heater capable of quickly raising temperature.

Next, the lead portions 117, 117 will be described. The lead portions 117, 117 are continuous with the respective rear ends 116*k*, 116*k* of the heat-generating portion 116 and extend rearward in the direction of the axis AX while having the same thickness (same cross-sectional area). The lead portions 117, 117 are formed thicker than the heat-generating portion 116 so as to achieve low resistance. As is apparent from FIG. 4, which shows a cross section taken along line B-B of FIG. 2 (cross section perpendicular to the direction of the axis AX), the lead portions 117, 117 each also have a generally elliptical cross section and face each other symmetrically with respect to the imaginary straight line tl including the center g of the insulating substrate 111.

The ceramic heater 110 has an entire cross-sectional area Sa of 8.55 $mm^2$. The lead portions 117, 117 have a total cross-sectional area S1 of 1.68 $mm^2$. Therefore, the ceramic heater 110 exhibits S1=0.20 Sa, so that the ceramic heater 110 satisfies an expression S1≦0.34 Sa and further satisfies an expression S1≦0.25 Sa. Meanwhile, the ceramic heater 110 also satisfies an expression S1≧0.15 Sa.

As mentioned previously, the difference in thermal expansion coefficient at room temperature between the insulating substrate 111 (thermal expansion coefficient 3.2 ppm/° C.) and the heat-generating resistor 115 (thermal expansion coefficient 3.8 ppm/° C.) is 0.6 ppm/° C. or greater. Therefore, as a result of subjection to thermal stress in the course of manufacture or use of the ceramic heater 110, a defect, such as generation of a gap at the interface between the insulating substrate 111 and the heat-generating resistor 115, is apt to occur. Also, since the heat-generating resistor 115 has a long overall length L (see FIG. 2) of 30 mm or greater (specifically, 40.0 mm), the difference in thermal expansion along the axial direction between the insulating substrate 111 and the heat-generating resistor 115 increases in the course of manufacture or use. Accordingly, a corresponding large thermal stress arises in the course of manufacture or use. Thus, the above-mentioned defect is particularly apt to occur.

However, in Embodiment 1, the total cross-sectional area S1 of the lead portions 117, 117 is reduced so as to satisfy the expression S1≦0.34 Sa and further satisfy the expression S1≦0.25 Sa. Reducing the total cross-sectional area S1 of the lead portions 117, 117 in this manner lowers stress imposed on the interface between the insulating substrate 111 and each of the lead portions 117, 117 in the course of manufacture or use. Therefore, at the interface between the insulating substrate 111 and each of the lead portions 117, 117, a defect, such as generation of a gap therebetween, becomes less likely to occur than in a conventional practice.

On the other hand, in Embodiment 1, the total cross-sectional area S1 of the lead portions 117, 117 satisfies the expression S1≧0.15 Sa. This can restrain occurrence of crack or the like in the heat-generating resistor 115 (lead portion 117) itself in the course of manufacture or use, so that a good heat-generating resistor can be yielded.

Furthermore, in Embodiment 1, as mentioned previously, silicon nitride grains contained in the heat-generating resistor 115 have an average grain size of 0.5 μm to 0.8 μm (specifically, 0.6 μm). This can further restrain a defect, such as generation of a gap at the interface between the heat-generating resistor 115 and the insulating substrate 111.

As shown in FIG. 4, in the cross section of a portion of the ceramic heater 110 in which the lead portions 117, 117 extend, of imaginary straight lines which pass through the center g of the cross section and along which a gap between the paired lead portions 117, 117 is measured, an imaginary straight line associated with a minimum gap is defined as a minimum-gap-associated imaginary straight line kl. As measured on the minimum-gap-associated imaginary straight line kl, the gap between the paired lead portions 117, 117 is taken as a, and dimensions of the paired lead portions 117, 117 are taken as b and c, respectively. In Embodiment 1, the gap a (the minimum thickness of a portion 111*m* of the insulating substrate 111 intervening between the lead portions 117, 117) is 0.43 mm (a=0.43 mm). The dimensions b and c of the respective lead portions 117, 117 are both 1.00 mm (b=c=1.00 mm). Portions 111*n*, 111*n* of the insulating substrate 111 which are located radially outward of and cover the respective lead portions 117, 117 have respective thicknesses d and e (as measured on the minimum-gap-associated imaginary straight line kl) of 0.435 mm (d=e=0.435 mm). Therefore, the ceramic heater 110 satisfies an expression a≧0.15(b+c). The ceramic heater 110 also satisfies an expression a≦D−(b+c)−0.2.

As mentioned previously, the difference in thermal expansion coefficient at room temperature between the insulating substrate 111 and the heat-generating resistor 115 is 0.6 ppm/° C. or greater. Therefore, as a result of subjection to thermal stress in the course of manufacture or use of the ceramic heater 110, a defect, such as generation of a gap at the interface between the insulating substrate 111 and the heat-generating resistor 115, is apt to occur. Such a defect is particularly apt to occur at the interface between each of the lead portions 117, 117 and the portion 111*m* of the insulating substrate 111 intervening between the lead portions 117, 117.

However, in Embodiment 1, the gap a between the lead portions 117, 117 is increased so as to satisfy the expression a≧0.15(b+c). This lowers stress which is imposed on the portion 111*m* of the insulating substrate 111 intervening between the lead portions 117, 117, in the course of manufacture or use. Therefore, at the interface between each of the lead portions 117, 117 and the portion 111*m* of the insulating substrate 111 intervening between the lead portions 117, 117, a defect, such as generation of a gap therebetween, becomes less likely to occur than in a conventional practice.

A defect, such as generation of a gap between the heat-generating resistor 115 and the insulating resistor 111 is apt to occur also at the interfaces between the lead portions 117, 117 and the respective portions 111*n*, 111*n* of the insulating substrate 111 which are located radially outward of and cover the respective lead portions 117, 117. Therefore, the portions 111*n*, 111*n* of the insulating substrate 111 which cover the respective lead portions 117, 117 from the radially outside of the lead portions 117, 117 must have a sufficient thickness to restrain occurrence of a defect, such as generation of a gap.

By contrast, in Embodiment 1, the gap a between the lead portions 117, 117 is reduced so as to satisfy the expression a≦D−(b+c)−0.2. Through employment of the gap a satisfying the relation, the insulating substrate 111 can be such that its portions (111*n*) located radially outward of the respective lead portions 117, 117 each have a thickness of 0.1 mm or greater (specifically, 0.435 mm). Therefore, in the course of manufacture or use, at the interfaces between the lead portions 117, 117 and the respective portions 111*n*, 111*n* of the insulating substrate 111 which cover the respective lead portions 117, 117, a defect, such as generation of a gap therebetween, becomes less likely to occur than in a conventional practice.

As shown in FIG. 5, in the cross section of the ceramic heater 110, of intersections of the minimum-gap-associated imaginary straight line kl and an outline 117*y* of one lead portion 117 (left one in FIG. 5), an intersection located on a side toward the center g is defined as a point A. Of intersections of the minimum-gap-associated imaginary straight line kl and the outline 117*y* of the other lead portion 117 (right one in FIG. 5), an intersection located on a side toward the center g is defined as a point E. In the cross section, an imaginary circle kc is drawn with the center g of the cross section as a center of the imaginary circle kc and with half of the diameter D (3.3 mm) of the cross section as a diameter DK (1.65 mm) of the imaginary circle kc. Intersections of the imaginary circle kc and the outline 117*y* of the one lead portion 117 (left one in FIG. 5) are defined as a point B and a point C. Intersections of the imaginary circle kc and the outline 117*y* of the other lead portion 17 (right one in FIG. 5) are defined as a point F and a point G. An angle formed by a line segment AB and a line segment AC is taken as α, and an angle formed by a line segment EF and a line segment EG is taken as β. In the ceramic heater 110 of Embodiment 1, the angle α formed by the line segment AB and the line segment AC, and the angle β formed by the line segment EF and the line segment EG both range from 160 degrees to 175 degrees (specifically, 170 degrees).

When the angle α formed by the line segments AB and AC or the angle β formed by the line segments EF and EG is less than 160 degrees, stress is apt to concentrate particularly in the vicinity of the points A and E at the interface between the insulating substrate 111 and each of the lead portions 117, 117 in the course of manufacture or use. Thus, in the vicinity of the points A and E, a defect, such as generation of a gap at the interface between the insulating substrate 111 and each of the lead portions 117, 117, is apt to occur. When the angle α or the angle β is in excess of 175 degrees, in a process of injection-molding a green heat-generating resistor 115, difficulty may be encountered in removal of the green heat-generating resistor 115 from a mold, as will be described later.

By contrast, in Embodiment 1, the angle α and the angle β are 160 degrees or greater, thereby restraining concentration of stress in the vicinity of the points A and E. Accordingly, a defect, such as generation of a gap at the interface between the insulating substrate 111 and each of the lead portions 117, 117; particularly, in the vicinity of the points A and E, can be effectively prevented. Since the angle α and the angle β are 175 degrees or less, in a process of injection-molding a green heat-generating resistor 115, the green heat-generating resistor 115 can be reliably removed from a mold, as will be described later.

Next, the lead lead-out portions 118*a*, 118*b* will be described (see FIG. 2). The lead lead-out portions 118*a*, 118*b* are continuous with the respective lead portions 117, 117 and extend radially outward to be exposed outward. The lead lead-out portions 118*a*, 118*b* are arranged with a gap K of 5 mm or greater (5 mm in Embodiment 1) therebetween along the direction of the axis AX. The lead lead-out portion 118*a* located on the front side (lower side in FIGS. 1 and 2) is electrically connected to the metallic shell 150 via the fixing tube 120. The lead lead-out portion 118*b* located on the rear side (upper side in FIGS. 1 and 2) is electrically connected to an energization terminal 151 via a lead coil 153, as will be described later.

As mentioned previously, if the lead lead-out portions 118*a*, 118*b* are arranged close to each other, the percentage of a conductive ceramic increases in the vicinity of the lead lead-out portions 118*a*, 118*b*, thereby increasing thermal stress which arises in the course of manufacture or use of the ceramic heater 110. As a result, in the vicinity of the lead lead-out portions 118*a*, 118*b*, a defect, such as generation of a gap at the interface between the insulating substrate 111 and the heat-generating resistor 115, is apt to occur.

However, in Embodiment 1, as mentioned above, the lead lead-out portions 118*a*, 118*b* are arranged with a gap K of 5 mm or greater therebetween, thereby lowering thermal stress which arises in the course of manufacture or use. Therefore, a defect, such as generation of a gap at the interface between the insulating substrate 111 and the heat-generating resistor 115, can be restrained.

As mentioned above, in the ceramic heater 110 of Embodiment 1, a defect, such as generation of a gap at the interface between the insulating substrate 111 and the heat-generating resistor 115, can be restrained. Specifically, in the course of manufacture of conventional ceramic heaters, two of 100 products have involved a defect, such as generation of a gap at the interface between the insulating substrate and the heat-generating resistor. By contrast, in the course of manufacture of the ceramic heaters 110 of Embodiment 1, none of 100 products has involved a defect, such as generation of a gap at the interface between the insulating substrate and the heat-generating resistor.

Examples 1 to 12

In order to verify the effect of Embodiment 1, 12 kinds of ceramic heaters 110 were manufactured as Examples 1 to 12 according to the present invention while the total cross-sectional area S1 of the lead portions 117, 117 and the total cross-sectional area S2 of the heat-generating portion 116 were varied. Specifically, as shown in Table 1, the total cross-sectional area S1 of the lead portions 117, 117 was set to 0.20 Sa, 0.25 Sa, 0.30 Sa, or 0.34 Sa. Also, the total cross-sectional area S2 of the heat-generating portion 116 was set to 0.05 Sb, 0.08 Sb, 0.16 Sb, or 0.18 Sb.

Meanwhile, four kinds of ceramic heaters 110 were manufactured as Comparative Examples 1 to 4 while the total cross-sectional area S1 of the lead portions 117, 117 and the total cross-sectional area S2 of the heat-generating portion 116 were varied. Specifically, as shown in Table 1, the total cross-sectional area S1 of the lead portions 117, 117 was set to 0.40 Sa or 0.50 Sa. Also, the total cross-sectional area S2 of the heat-generating portion 116 was set to 0.05 Sb or 0.18 Sb.

The cross-sectional areas Sa and Sb of the ceramic heaters 110 were set to 8.55 $mm^2$ as in the case of Embodiment 1 described above. As will be described in detail later, the angle α formed by the line segment AB and the line segment AC and the angle β formed by the line segment EF and the line segment EG were set to 170 degrees as in the case of Embodiment 1 described above.

The ceramic heaters 110 were measured for residual stress. Specifically, the residual stress was obtained from toughness which was measured at a cut position by the method specified in JIS R1607 "Testing Methods for Fracture Toughness of Fine Ceramics." Measured values of toughness were converted to values of residual stress by FEM analysis.

The ceramic heaters 110 were subjected to a service durability test. Specifically, the service durability test was conducted as follows. A DC power source was connected to the ceramic heater 110, and voltage was adjusted such that the surface temperature of the ceramic heaters 110 reaches 1,450° C. in two seconds in an environment of room temperature. Each of the ceramic heaters 110 was heated through application of the voltage and was subsequently air-cooled for 30 seconds so as to be cooled to room temperature. With this procedure taken as one cycle, the number of cycles until the heat-generating resistor 115 fractured was measured.

Also, the ceramic heaters 110 were measured for time to reach 1,000° C. when a voltage of 11 V was applied.

TABLE 1

| | Cross-sectional area S1 | Cross-sectional area S2 | Residual stress (Mpa) | Service durability (cycles) | Eval. of service durability | Time to reach 1,000° C. (s) | Eval. of time to reach 1,000° C. |
|---|---|---|---|---|---|---|---|
| Ex. 1 | 0.20Sa | 0.05Sb | 118 | 30,000 or more | A | 1.70 | A |
| Ex. 2 | 0.20Sa | 0.08Sb | 126 | 30,000 or more | A | 1.80 | A |
| Ex. 3 | 0.20Sa | 0.16Sb | 120 | 30,000 or more | A | 2.00 | B |
| Ex. 4 | 0.20Sa | 0.18Sb | 119 | 30,000 or more | A | 3.00 | C |
| Ex. 5 | 0.25Sa | 0.08Sb | 135 | 20,000 or more | A | 1.70 | A |
| Ex. 6 | 0.25Sa | 0.18Sb | 137 | 20,000 or more | A | 2.60 | C |
| Ex. 7 | 0.30Sa | 0.05Sb | 156 | 10,000 or more | B | 1.60 | A |
| Ex. 8 | 0.30Sa | 0.18Sb | 149 | 10,000 or more | B | 2.50 | C |

TABLE 1-continued

| | Cross-sectional area S1 | Cross-sectional area S2 | Residual stress (Mpa) | Service durability (cycles) | Eval. of service durability | Time to reach 1,000° C. (s) | Eval. of time to reach 1,000° C. |
|---|---|---|---|---|---|---|---|
| Ex. 9 | 0.34Sa | 0.05Sb | 168 | 10,000 or more | B | 1.65 | A |
| Ex. 10 | 0.34Sa | 0.08Sb | 176 | 10,000 or more | B | 1.70 | A |
| Ex. 11 | 0.34Sa | 0.16Sb | 169 | 10,000 or more | B | 1.90 | B |
| Ex. 12 | 0.34Sa | 0.18Sb | 175 | 10,000 or more | B | 2.00 | C |
| Comp. Ex. 1 | 0.40Sa | 0.05Sb | 255 | 9,036 | P | — | — |
| Comp. Ex. 2 | 0.40Sa | 0.18Sb | 256 | 8,639 | P | — | — |
| Comp. Ex. 3 | 0.50Sa | 0.05Sb | 266 | 7,596 | P | — | — |
| Comp. Ex. 4 | 0.50Sa | 0.18Sb | 274 | 8,023 | P | — | — |

As shown in Table 1, Examples 1 to 6 in which the total cross-sectional area S1 of the lead portions 117, 117 was 0.20 Sa or 0.25 Sa exhibited a low residual stress of 118 MPa to 137 MPa. In the service durability test, Examples 1 to 6 were free from a defect, such as generation of a gap at the interface between the insulating substrate 111 and each of the lead portions 117, 117 at less than 20,000 cycles. The results of the service durability test were evaluated to be very good, so that, in Table 1, Examples 1 to 6 were marked with "A" with respect to service durability.

Examples 7 to 12 in which the total cross-sectional area S1 of the lead portions 117, 117 was 0.30 Sa or 0.34 Sa exhibited a relatively low residual stress of 149 MPa to 176 MPa. In the service durability test, Examples 7 to 12 failed to reach 20,000 cycles, but were free from a defect, such as generation of a gap at the interface between the insulating substrate 111 and each of the lead portions 117, 117 at less than 10,000 cycles. The results of the service durability test were evaluated to be relatively good, so that, in Table 1, Examples 7 to 12 were marked with "B" with respect to service durability.

Meanwhile, Comparative Examples 1 to 4 exhibited a relatively high residual stress of 255 MPa to 274 MPa. In the service durability test, Comparative Examples 1 to 4 suffered generation of a gap at the interface between the insulating substrate 111 and each of the lead portions 117, 117 at a relatively early stage (7,596 cycles to 9,036 cycles) below 10,000 cycles. The results of the service durability test were evaluated to be poor, so that, in Table 1, Comparative Examples 1 to 4 were marked with "P" with respect to service durability.

As is apparent from these results of the service durability test, imparting, to the lead portions 117, 117, the total cross-sectional area S1 which satisfies S1≦0.34 Sa, preferably S1≦0.25 Sa, can effectively restrain a defect, such as generation of a gap at the interface between the insulating substrate 111 and each of the lead portions 117, 117.

Examples 1, 2, 5, 7, 9, and 10 in which the total cross-sectional area S2 of the heat-generating portion 116 was 0.05 Sb or 0.08 Sb exhibited a very short time-to-reach-1,000° C. of 1.80 s or less. The exhibited time to reach 1,000° C. was evaluated to be very good, so that, in Table 1, Examples 1, 2, 5, 7, 9, and 10 were marked with "A" with respect to time to reach 1,000° C.

Examples 3 and 11 in which the total cross-sectional area S2 of the heat-generating portion 116 was 0.16 Sb exhibited a time-to-reach-1,000° C. in excess of 1.80 s, but a relatively short time of 2.00 s or less. The exhibited time to reach 1,000° C. was evaluated to be relatively good, so that, in Table 1, Examples 3 and 11 were marked with "B" with respect to time to reach 1,000° C.

Examples 4, 6, 8, and 12 in which the total cross-sectional area S2 of the heat-generating portion 116 was 0.18 Sb exhibited a relatively long time-to-reach-1,000° C. of 2.10 s or greater. The exhibited time to reach 1,000° C. was evaluated to be acceptable, so that, in Table 1, Examples 4, 6, 8, and 12 were marked with "C" with respect to time to reach 1,000° C.

As is apparent from these results of measurement, imparting, to the heat-generating portion 116, the total cross-sectional area S2 which satisfies S2≦0.16 Sb, preferably S2≦0.08 Sb, can sufficiently shorten time to reach 1,000° C. Notably, Comparative Examples 1 to 4, which were evaluated to be "P" with respect to the service durability test, were not measured for time to reach 1,000° C.

Examples 13 to 23

In order to further verify the effect of Embodiment 1, 11 kinds of ceramic heaters 110 were manufactured as Examples 13 to 23 according to the present invention while the total cross-sectional area S1 of the lead portions 117, 117 was varied within a range of 0.15 Sa to 0.34 Sa, and the angle α formed by the line segments AB and AC and the angle β formed by the line segments EF and EG was varied. Specifically, as shown in Table 2, the total cross-sectional area S1 of the lead portions 117, 117 was set to 0.15 Sa, 0.25 Sa, 0.30 Sa, or 0.34 Sa (Sa was set to 8.55 $mm^2$ as in the case of Embodiment 1 described above). The angle α and the angle β were set to 140 degrees, 150 degrees, 160 degrees, 170 degrees, or 175 degrees.

Meanwhile, three kinds of ceramic heaters 110 were manufactured as Comparative Examples 5 to 7 while the total cross-sectional area S1 of the lead portions 117, 117, and the angle α formed by the line segments AB and AC and the angle β formed by the line segments EF and EG were varied. Specifically, as shown in Table 2, the total cross-sectional area S1 of the lead portions 117, 117 was set to 0.10Sa, 0.40Sa, or 0.50Sa. Also, the angle α and the angle β were set to 140 degrees, 160 degrees, or 170 degrees.

The gap a between the lead portions 117, 117 of each of the ceramic heaters 110 was set to 1.0 mm.

The ceramic heaters 110 were subjected to the above-mentioned service durability test until a gap was generated between the insulating substrate 111 and each of the lead portions 117, 117, and the associated number of cycles was measured.

TABLE 2

| | Cross-sectional area S1 | Angle α, β (degrees) | Service durability (cycles) | Service durability ratio |
|---|---|---|---|---|
| Example 13 | 0.15Sa | 170 | 55,128 | 1.00 |
| Example 14 | 0.25Sa | 140 | 16,536 | 0.59 |
| Example 15 | 0.25Sa | 170 | 28,056 | 1.00 |
| Example 16 | 0.30Sa | 140 | 13,489 | 0.69 |
| Example 17 | 0.30Sa | 160 | 16,049 | 0.82 |
| Example 18 | 0.30Sa | 170 | 19,520 | 1.00 |
| Example 19 | 0.34Sa | 140 | 12,280 | 0.70 |
| Example 20 | 0.34Sa | 150 | 13,300 | 0.76 |
| Example 21 | 0.34Sa | 160 | 14,026 | 0.80 |
| Example 22 | 0.34Sa | 170 | 17,503 | 1.00 |
| Example 23 | 0.34Sa | 175 | 19,087 | 1.09 |
| Comp. Ex. 5 | 0.40Sa | 140 | 7,129 | 0.75 |
| Comp. Ex. 6 | 0.50Sa | 160 | 7,801 | 0.82 |
| Comp. Ex. 7 | 0.50Sa | 170 | 9,563 | 1.00 |

As is apparent from Table 1 showing the results of the service durability test, Examples 1 to 12 having angles α and β of 170 degrees and a cross-sectional area S1 of 0.20 Sa to 0.34 Sa exhibited good service durability.

Similarly, as is apparent from Table 2 showing the results of the service durability test, Examples 13, 15, 18, and 22 having angles α and β of 170 degrees and a cross-sectional area S1 of 0.15 Sa to 0.34 Sa (specifically, Example 13: S1=0.15 Sa; Example 15: S1=0.25 Sa; Example 18: S1=0.30 Sa; and Example 22: S1=0.34 Sa) exhibited good service durability. Specifically, the exhibited number of cycles in the service durability test was as follows: Example 3: 55,128 cycles; Example 15: 28,056 cycles; Example 18: 19,520 cycles; and Example 22: 17,503 cycles.

Example 13 exhibits particularly good result, conceivably because the cross-sectional area S1 is the smallest of the four samples, so that residual stress is the lowest. Example 23, which employs large angles α and β of 175 degrees falling within a range for facilitating formation of the heat-generating resistor 115, exhibited a number of cycles of 19,087 in the service durability test, which is better than that of Example 22 having the same cross-sectional area S1 as Example 23.

The results of the service durability test in Table 1 are used as reference for evaluation; i.e., samples having angles α and β of 170 degrees are used as reference samples. When samples which have the same cross-sectional area S1 are compared with each other, "service durability ratio" in Table 2 is the ratio of service durability of a sample having angles α and β of other than 170 degrees to service durability of a sample having angles α and β of 170 degrees.

As is apparent from comparison of service durability ratios, Examples 17 and 21 having angles α and β of 160 degrees maintain service durability which is about 80% of those of respective reference samples (having angles α and β of 170 degrees). By contrast, Examples 14, 16, and 19 having angles α and β of 140 degrees and Example 20 having angles α and β of 150 degrees are considerably lower in service durability as compared with respective reference samples. This indicates that increasing the angles α and β only to the extent that forming work is not affected is preferred, and that a lower limit to service durability is 160 degrees or greater in view of service durability.

Example 14 having a cross-sectional area S1 of 0.25 Sa and angles α and β of 140 degrees shows a significant drop in service durability ratio from the levels of Examples 16 and 19. This indicates that the degree of influence of the angles α and β on service durability tends to increase as the cross-sectional area S1 decreases.

A similar tendency was confirmed when Comparative Examples 5, 6, and 7 having a cross-sectional area S1 in excess of 0.34Sa underwent a similar test. Comparative Example 5 having angles α, and β of 140 degrees shows a small drop in service durability ratio from the level of Comparative Example 7. This indicates that the degree of influence of the angles α and β on service durability is small in the case of a large cross-sectional area S1; specifically, a cross-sectional area S1 in excess of 0.34 Sa; i.e., the degree of influence of the angles α and β on service durability is small when the cross-sectional area S1 is 0.34 Sa or less.

As is apparent from these results of measurement, imparting, to the lead portions 117, 117, the total cross-sectional area S1 which satisfies S1≦0.34 Sa, preferably S1≦0.25 Sa, can effectively restrain a defect, such as generation of a gap at the interface between the insulating substrate 111 and each of the lead portions 117, 117.

Also, employment of angles α and β of 160 degrees to 175 degrees can effectively restrain a defect, such as generation of a gap at the interface between the insulating substrate 111 and each of the lead portions 117, 117, in the service durability test.

Examples 24 to 32

In order to further verify the effect of Embodiment 1, nine kinds of ceramic heaters 110 were manufactured as Examples 24 to 32 according to the present invention while the total cross-sectional area S1 of the lead portions 117, 117, the gap a between the lead portions 117, 117, and the lateral dimensions b and c (along the direction of juxtaposition) of the respective lead portions 117, 117 were varied. Specifically, as shown in Table 3, the total cross-sectional area S1 of the lead portions 117, 117 was set to 0.30 Sa or 0.34 Sa. The gap a between the lead portions 117, 117 was set to 0.15 mm, 0.20 mm, 0.29 mm, 0.70 mm, 1.00 mm, 1.20 mm, 1.25 mm, or 1.50 mm. The lateral dimensions b and c of the respective lead portions 117, 117 were set to 0.82 mm (b+c=1.64 mm) or 0.94 mm (b+c=1.88 mm).

The ceramic heaters 110 were measured for residual stress and were subjected to the service durability test, by the above-mentioned respective methods.

Also, the ceramic heaters 110 were measured for flexural strength. Specifically, the flexural strength was measured by the following flexural-strength measuring method in accordance with JIS R1601. Each of the ceramic heaters 110 was supported at opposite sides of the center of the ceramic heater 110 along the direction of the axis AX (span: 12 mm), and load was applied to the center of the ceramic heater 110 at a crosshead-moving speed of 0.5 mm/min.

TABLE 3

| | Cross-sectional area S1 | a (mm) | b + c (mm) | a ≧ 0.15(b + c) | a ≦ D − (b + c) − 0.2 | Residual stress (MPa) | Flexural strength (MPa) | Service durability (cycles) |
|---|---|---|---|---|---|---|---|---|
| Ex. 24 | 0.30Sa | 0.20 | 1.64 | X | ○ | 180 | 1,005 | 16,158 |
| Ex. 25 | 0.30Sa | 1.00 | 1.64 | ○ | ○ | 153 | 986 | 19,503 |
| Ex. 26 | 0.30Sa | 1.50 | 1.64 | ○ | X | 125 | 692 | 35,562 |
| Ex. 27 | 0.34Sa | 0.15 | 1.88 | X | ○ | 225 | 1,255 | 12,501 |
| Ex. 28 | 0.34Sa | 0.20 | 1.88 | X | ○ | 215 | 1,165 | 13,369 |
| Ex. 29 | 0.34Sa | 0.29 | 1.88 | ○ | ○ | 200 | 1,265 | 14,005 |
| Ex. 30 | 0.34Sa | 0.70 | 1.88 | ○ | ○ | 185 | 1,045 | 15,050 |
| Ex. 31 | 0.34Sa | 1.20 | 1.88 | ○ | ○ | 160 | 1,036 | 17,503 |
| Ex. 32 | 0.34Sa | 1.25 | 1.88 | ○ | X | 155 | 756 | 18,569 |

As is apparent from Table 3, of Examples 24 to 26 having a total cross-sectional area S1 of the lead portions 117, 117 of 0.30 Sa, Examples 25 and 26 which satisfies a≧0.15(b+c) (marked with "O" in Table 3) exhibited the effect of effectively lowering residual stress. Since Examples 25 and 26 are small in cross-sectional area S1 in relation to other Examples, Examples 25 and 26 exhibited good service durabilities of 19,503 cycles and 35,562 cycles, respectively.

Example 24 having a distance gap a of 0.20 mm involved no problem in terms of a completed product as a ceramic heater. However, Example 24 may involve the following problems. Burrs which are generated in a process of injection-molding the heat-generating resistor 115 may cause a short circuit. Since a process of removing the burrs requires accurate working, yield may drop.

Examples 24 and 25 which satisfy a≦D−(b+c)−0.2 (marked with "O" in Table 3) exhibited a good flexural strength of 1,005 MPa and 986 MPa, respectively.

Example 26 having a gap a of 1.5 mm exhibited high service durability stemming from lowering of residual stress, but exhibited a rather low flexural strength not higher than 800 MPa; specifically, 692 MPa. Service durability and flexural strength are in a trade-off relation with each other. Example 25 implements high service durability and high flexural strength.

Next, Examples 27 to 32 having a cross-sectional area S1 of 0.34 Sa will be described. These Examples also show a tendency similar to that of Examples 24 to 26 having a cross-sectional area S1 of 0.30 Sa. Specifically, Examples 27 and 28 which do not satisfy a≧0.15(b+c) are high in residual stress and low in service durability in relation to other Examples, but exhibits high flexural strength.

By contrast, Example 32 which does not satisfy a≦D−(b+c)−0.2 can lower residual stress, and exhibits excellent service durability in spite of a relatively large cross-sectional area S1; however, Example 32 exhibits a rather low flexural strength not higher than 800 MPa; specifically, 756 MPa, as in the case of Example 26 mentioned above. Examples 29 to 31 implement high service durability and high flexural strength.

Examples 33 to 35

In order to further verify the effect of Embodiment 1, three kinds of ceramic heaters 110 were manufactured as Examples 33 to 35 according to the present invention while the overall length L of the heat-generating resistor 115 along the direction of the axis AX was varied. Specifically, as shown in Table 4, the total cross-sectional area S1 of the lead portions 117, 117 was set to 0.34 Sa (Sa=8.55 $mm^2$), and the overall length L of the heat-generating resistor 115 along the direction of the axis AX was set to 25 mm, 30 mm, or 40 mm.

Meanwhile, three kinds of ceramic heaters 110 were manufactured as Comparative Examples 8 to 10 while the overall length L of the heat-generating resistor 115 along the direction of the axis AX was varied. Specifically, as shown in Table 4, the total cross-sectional area S1 of the lead portions 117, 117 was set to 0.40 Sa (Sa=8.55 $mm^2$), and the overall length L of the heat-generating resistor 115 along the direction of the axis AX was set to 25 mm, 30 mm, or 40 mm.

The gap a between the lead portions 117, 117 of each of the ceramic heaters 110 was set to 1.0 mm.

The ceramic heaters 110 were measured for residual stress and were subjected to the service durability test, by the above-mentioned respective methods. Notably, for Comparative Examples 8 to 10, only measurement of residual stress was carried out.

TABLE 4

| | Cross-sectional area S1 | Overall length L (mm) | Residual stress (MPa) | Service durability (cycles) |
|---|---|---|---|---|
| Example 33 | 0.34Sa | 25 | 140 | 20,069 |
| Example 34 | 0.34Sa | 30 | 150 | 19,865 |
| Example 35 | 0.34Sa | 40 | 170 | 18,634 |
| Comp. Ex. 8 | 0.40Sa | 25 | 170 | — |
| Comp. Ex. 9 | 0.40Sa | 30 | 190 | — |
| Comp. Ex. 10 | 0.40Sa | 40 | 255 | — |

As shown in Table 4, Examples 33 to 35 exhibited high service durability.

Both of Example 33 and Comparative Example 8 have an overall length L of 25 mm; however, Example 33 having a cross-sectional area S1 of 0.34 Sa exhibits lowering of residual stress in relation to Comparative Example 8 having a cross-sectional area S1 of 0.40 Sa. Therefore, it can be presumed that Example 33 improves in service durability in relation to Comparative Example 8.

Similarly, both of Example 34 and Comparative Example 9 have an overall length L of 30 mm; however, Example 34 having a cross-sectional area S1 of 0.34 Sa exhibits lowering of residual stress in relation to Comparative Example 9 having a cross-sectional area S1 of 0.40 Sa. Therefore, it can be presumed that Example 34 improves in service durability in relation to Comparative Example 9.

Similarly, both of Example 35 and Comparative Example 10 have an overall length L of 40 mm; however, Example 35 having a cross-sectional area S1 of 0.34 Sa exhibits lowering of residual stress in relation to Comparative Example 10 having a cross-sectional area S1 of 0.40 Sa. Therefore, it can be presumed that Example 35 improves in service durability in relation to Comparative Example 10.

Comparing Examples 33 to 35 and comparing Comparative Examples 8 to 10 indicates that residual stress increases with the overall length L.

Of Comparative Examples 8 to 10, Comparative Example 8 having a short overall length L of the heat-generating resistor 115 (specifically, 25 mm) has a large cross-sectional area S1 (specifically, 0.40 Sa) in excess of 0.34 Sa, but exhibits lowering of residual stress to a certain extent. By contrast, Comparative Examples 9 and 10 having a long overall length L of the heat-generating resistor 115 (specifically, 30 mm or greater) exhibit high residual stress. Therefore, the present invention in which the cross-sectional area S1 is reduced can yield its effect remarkably through application to a ceramic heater whose heat-generating resistor 115 has an overall length L of 30 mm or greater along the direction of the axis AX.

Examples 36 to 38

In order to further verify the effect of Embodiment 1, three kinds of ceramic heaters 110 were manufactured as Examples 36 to 38 according to the present invention while the gap K between the lead lead-out portions 118*a*, 118*b* along the direction of the axis AX was varied. Specifically, as shown in Table 5, the total cross-sectional area S1 of the lead portions 117, 117 was set to 0.34 Sa (Sa=8.55 $mm^2$), and the gap K between the lead lead-out portions 118*a*, 118*b* was set to 3.0 mm, 5.0 mm, or 8.0 mm.

The gap a between the lead portions 117, 117 of each of the ceramic heaters 110 was set to 1.0 mm.

The ceramic heaters 110 were measured for residual stress by the above-mentioned method.

TABLE 5

| | Cross-sectional area S1 | K (mm) | Residual stress (MPa) | Evaluation of residual stress |
|---|---|---|---|---|
| Example 36 | 0.34Sa | 3.0 | 198 | ○ |
| Example 37 | 0.34Sa | 5.0 | 170 | ○○ |
| Example 38 | 0.34Sa | 8.0 | 150 | ○○ |

As shown in Table 5, Example 37 having a gap K of 5.0 mm between the lead lead-out portions 118*a*, 118*b* exhibited a sufficiently low residual stress of 170 MPa, and Example 38 having a gap K of 8.0 mm exhibited a sufficiently low residual stress of 150 MPa. In Table 5, these exhibited residual stresses were evaluated to be very good, so that Examples 37 and 38 were marked with "OO" with respect to residual stress.

Example 36 having a gap K of 3.0 mm exhibited a residual stress of 198 MPa slightly higher than those of Examples 37 and 38. In Table 5, the exhibited residual stress was evaluated to be relatively good, so that Example 36 was marked with "O" with respect to residual stress.

As is apparent from these results of measurement, employing a gap K of 5 mm or greater between the lead lead-out portions 118*a*, 118*b* lowers residual stress. Therefore, in the course of manufacture or use, a defect, such as generation of a gap at the interface between the insulating substrate 111 and each of the lead portions 117, 117, can be effectively restrained.

Examples 39 to 42

In order to further verify the effect of Embodiment 1, four kinds of ceramic heaters 110 were manufactured as Examples 39 to 42 according to the present invention while the average grain size of silicon nitride grains (hereinafter, may be referred to as silicon-nitride grain size) contained in the heat-generating resistor 115 was varied. Specifically, as shown in Table 6, the total cross-sectional area S1 of the lead portions 117, 117 was set to 0.34 Sa (Sa=8.55 $mm^2$), and the silicon-nitride grain size was set to 0.3 μm, 0.5 μm, 0.8 μm, or 1.0 μm.

The gap a between the lead portions 117, 117 of each of the ceramic heaters 110 was set to 1.0 mm.

The ceramic heaters 110 were measured for residual stress and flexural strength by the above-mentioned respective methods.

TABLE 6

| | Cross-sectional area S1 | Silicon-nitride grain size (μm) | Residual stress (MPa) | Evaluation of residual stress | Flexural strength (MPa) | Evaluation of flexural strength |
|---|---|---|---|---|---|---|
| Example 39 | 0.34Sa | 0.3 | 215 | ○ | 1,243 | ○○ |
| Example 40 | 0.34Sa | 0.5 | 153 | ○○ | 1,223 | ○○ |
| Example 41 | 0.34Sa | 0.8 | 140 | ○○ | 1,173 | ○○ |
| Example 42 | 0.34Sa | 1.0 | 136 | ○○ | 735 | ○ |

As shown in Table 6, Examples 40 to 42 having a silicon-nitride grain size of 0.5 μm to 1 μm exhibited a sufficiently low residual stress of 136 MPa to 153 Mpa. In Table 6, the exhibited residual stresses were evaluated to be very good, so that Examples 40 to 42 were marked with "OO" with respect to residual stress.

Example 39 having a silicon-nitride grain size of 0.3 μm exhibited a residual stress of 215 MPa slightly higher than those of Examples 40 to 42. In Table 6, the exhibited residual stress was evaluated to be relatively good, so that Example 39 was marked with "O" with respect to residual stress.

As is apparent from these results of measurement, employing a silicon-nitride grain size of 0.5 μm to 1 μm lowers residual stress. Therefore, in the course of manufacture or use, a defect, such as generation of a gap at the interface between the insulating substrate 111 and each of the lead portions 117, 117, can be effectively restrained.

Examples 39 to 41 having a silicon-nitride grain size of 0.3 μm to 0.8 μm exhibited a sufficiently high flexural strength of 1,173 MPa to 1,243 MPa. In Table 6, the exhibited flexural strengths were evaluated to be very good, so that Examples 39 to 41 were marked with "OO" with respect to flexural strength.

Example 42 having a silicon-nitride grain size of 1 μm exhibited a flexural strength of 735 MPa slightly lower than those of Examples 39 to 41. In Table 6, the exhibited flexural strength was evaluated to be relatively good, so that Example 42 was marked with "O" with respect to flexural strength.

As is apparent from these results of measurement, employing a silicon-nitride grain size of 0.3 μm to 0.8 μm heightens flexural strength.

In view of the results of measurement of flexural strength and the previously mentioned residual stress, employing a silicon-nitride grain size of 0.5 μm to 0.8 μm yields the ceramic heater 110 which is good in terms of both residual stress and flexural strength.

Next, other members of the glow plug 100 will be described (see FIG. 1). The fixing tube 120 is attached to an outer circumference of the ceramic heater 110 and is fixed by means of a brazing material. The fixing tube 120 is inserted into the through-hole 150*h* of the metallic shell 150 and is fixed by means of a brazing material.

The rodlike energization terminal 151 extends through the tubular metallic shell 150. A front end portion 151*s* of the energization terminal 151 and a rear end portion 110*k* of the above-described ceramic heater 110 are electrically connected together via the lead coil 153. Specifically, the lead coil 153 is wound onto and welded to the front end portion 151*s* of the energization terminal 151, and is wound onto and welded to the rear end portion 110*k* of the ceramic heater 110 while being in contact with the lead lead-out portion 118*b* (see FIG. 2) located at the rear end portion 110*k*. A rear portion of the energization terminal 151 extends through the metallic shell 150 and projects rearward (upward in FIG. 1) from the rear end portion 150*k* of the metallic shell 150. The projecting portion of the energization terminal 151 is externally threaded, thereby forming an externally threaded portion 151*n*.

The rear end portion 150*k* of the metallic shell 150 is formed into a tool engagement portion 150*r* which has a hexagonal cross section and with which a tool, such as a torque wrench, is engaged when the glow plug 100 is attached to a diesel engine. A portion of the metallic shell 150 which is located immediately frontward of the tool engagement portion 150*r* is formed into a mounting threaded portion 150*t*. The rear end portion 150*k* of the metallic shell 150 has a counter sunk portion 150*z* formed at a portion of the through-hole 150*h* associated with the rear end portion 150*k*. An O-ring 161 made of rubber and an insulating bush 163 made of nylon which are fitted to the energization terminal 151 are fitted into the counter sunk portion 150*z*. A press ring 165 is fitted to the energization terminal 151 at a position located rearward of the insulating bush 163 so as to prevent detachment of the insulating bush 163. The press ring 165 is crimped onto the outer circumference of the energization terminal 151, thereby being fixed onto the energization terminal 151. In order to enhance crimp-bonding force, a portion of the energization terminal 151 corresponding to the press ring 165 is knurled on its outer circumferential surface, thereby forming a knurled portion 151*r*. A nut 167 is threadingly engaged with the energization terminal 151 at a position located rearward of the press ring 165. The nut 167 is adapted to fix an unillustrated energization cable to the energization terminal 151.

The thus-configured glow plug 100 is attached to a mounting hole formed in a cylinder head of an unillustrated diesel engine through utilization of the mounting threaded portion 150*t* of the metallic shell 150. This disposes the front end portion 110*s* of the ceramic heater 110 within a combustion chamber of the engine. In this state, when voltage is applied to the energization terminal 151 from a battery equipped in a vehicle, current flows from the energization terminal 151 through the lead coil 153, one lead lead-out portion 118*b*, one lead portion 117, the heat-generating portion 116, the other lead portion 117, the other lead lead-out portion 118*a*, and the metallic shell 150. This causes the front end portion 110*s* of the ceramic heater 110 in which the heat-generating portion 116 is present, to quickly increase in temperature. In a state in which a front end portion of the ceramic heater 110 is heated to a predetermined temperature, fuel is sprayed from an unillustrated fuel spray system. Thus, ignition of fuel is assisted, and fuel burns, thereby starting the diesel engine.

The ceramic heater 110 and the glow plug 100 described above can be manufactured by respectively known methods.

The ceramic heater 110 is manufactured as follows. 10 Parts by mass $Yb_2O_3$ powder and 2 parts by mass $SiO_2$ powder are added, as sintering aid, to 88 parts by mass silicon nitride material power, thereby yielding an insulating-component material. 40% By mass insulating-component material and 60% by mass WC powder, which is a conductive ceramic, are wet-mixed for 72 hours. The resultant mixture is dried, thereby yielding a mixture powder. Subsequently, the mixture powder and a binder are placed in a kneader and are then kneaded for four hours. Next, the resultant kneaded substance is cut into pellets. The thus-obtained pellets of the kneaded substance are charged into an injection molding machine, followed by injection into an injection molding mold having a U-shaped cavity corresponding to the heat-generating resistor 115. Thus is yielded a green heat-generating resistor of a conductive ceramic.

In this case, if the angle $\alpha$ formed by the line segment AB and the line segment AC or the angle $\beta$ (see FIG. 5) formed by the line segment EF and the line segment EG as viewed on the aforementioned cross-section of the lead portions 117, 117 are present is in excess of 175 degrees, difficulty may be encountered in removal of the green heat-generating resistor 115 from the mold. However, in Embodiment 1, the angle $\alpha$ and the angle $\beta$ are 175 degrees or less (specifically, 170 degrees). Therefore, the green heat-generating resistor 115 can be reliably removed from the mold.

11 Parts by mass $Yb_2O_3$ powder, 3 parts by mass $SiO_2$ powder, and 5 parts by mass $MoSi_2$ powder are added, as sintering aid, to 86 parts by mass silicon-nitride material powder. The resultant mixture is wet-mixed for 40 hours. The resultant mixture is spray-dried, thereby yielding a powder. The thus-obtained powder is compacted into two green halves. The two green halves correspond in shape to two halves obtained by halving the completed insulating substrate 111 along the axis AX. Each of the two green halves has a recess corresponding in shape to the above-mentioned green heat-generating resistor in the parting face of the green half. The green heat-generating resistor is sandwiched between the two green halves while being fitted into the recesses. The resultant assembly is pressed into a single piece, thereby yielding a green ceramic heater.

Next, the green ceramic heater is preliminarily fired at 600° C. in a nitrogen atmosphere so as to remove binder and the like from the injection-molded green heat-generating resistor and from the green insulating substrate, thereby yielding a preliminarily fired body. Subsequently, the preliminarily fired body is set in a press die made of graphite and is then hot-press-fired at 1,800° C. under a pressure of 29.4 MPa in a nitrogen atmosphere for 1.5 hour, thereby yielding a fired body. The surface (outer surface) of the fired body is subjected to centerless polishing, thereby completing the ceramic heater 110.

The glow plug 100 is manufactured in the following manner. First, the above-mentioned ceramic heater 110 and the energization terminal 151 are connected together via the lead coil 153. The fixing tube 120 is attached to the ceramic heater 110, and then the fixing tube 120 and the ceramic heater 110 are fixed together by means of a brazing material. Subsequently, the metallic shell 150 is prepared. An assembly of the ceramic heater 110, the energization terminal 151, and the fixing tube 110 is inserted into the through-hole 150*h* of the metallic shell 150. Then, the metallic shell 150 and the fixing tube 120 are fixed together by means of a brazing material. Subsequently, the O-ring 161 is fitted into the counter sunk portion 150*z* formed in the rear end portion 150*k* of the metallic shell 150, and then the insulating bush 163 is fitted into the counter sunk portion 150*z*. Then, the press ring 165 is attached by crimping. The nut 167 is fixed at a predetermined position, thereby completing the glow plug 100.

Embodiment 2

Next, Embodiment 2 will be described. Description of features similar to those of Embodiment 1 describe above is omitted or briefed. A ceramic heater 210 and a glow plug 200 of Embodiment 2 differ from the ceramic heater 110 and the glow plug 100 of Embodiment 1 described above in the form of arrangement of a pair of lead portions 217, 217 embedded in an insulating substrate 211. Other structural features are similar to those of Embodiment 1 described above and are therefore denoted by like reference numerals, and description thereof is omitted or briefed.

Figure 6:
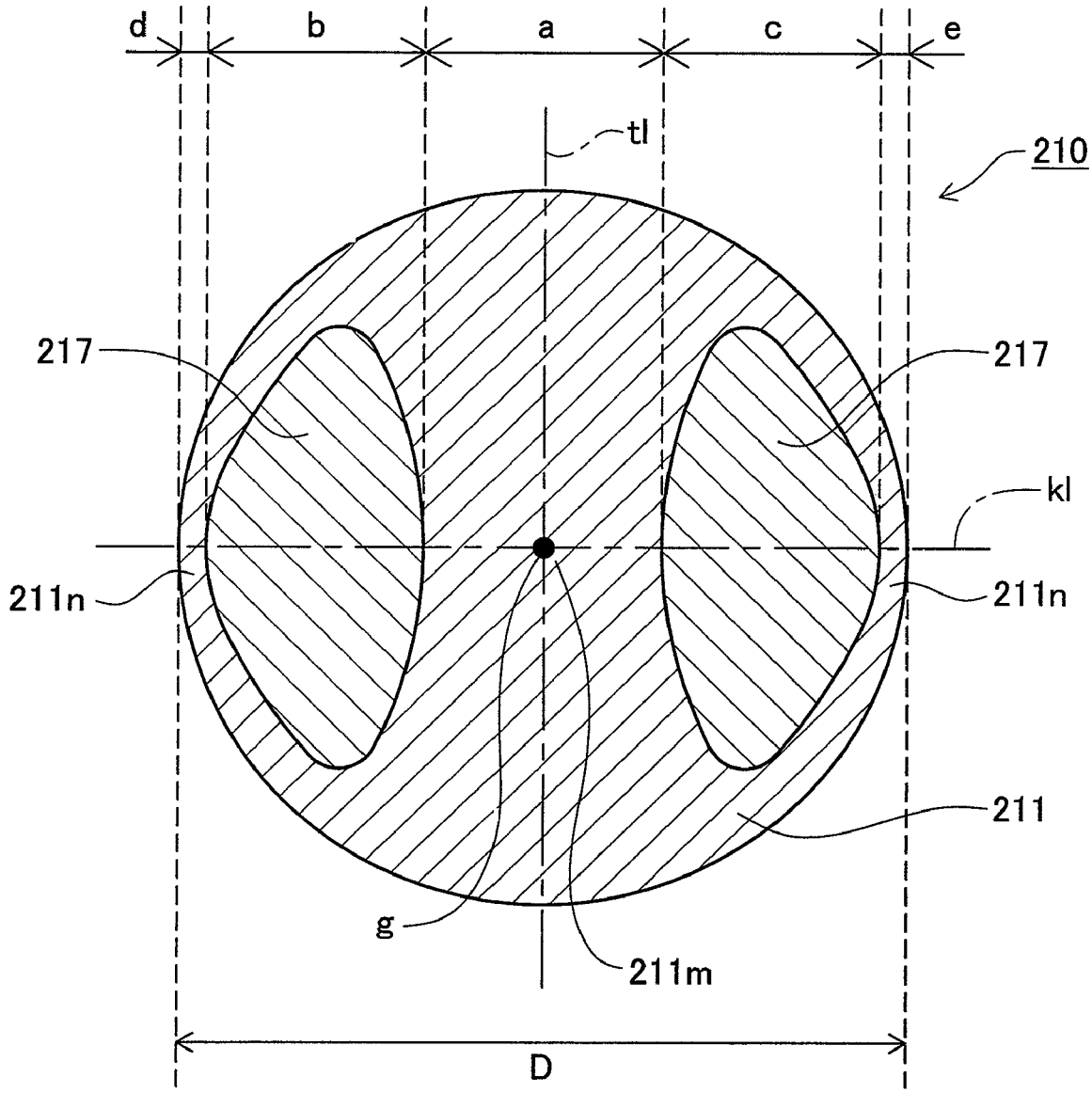
[FIG. 6] Cross-sectional view, equivalent to FIG. 4, of a ceramic heater according to Embodiment 2.

FIG. 6 is a cross-sectional view of the ceramic heater 210 (equivalent of FIG. 4 showing Embodiment 1). In Embodiment 2, the lead portions 217, 217 each also have a generally elliptical cross section, and face each other symmetrically with respect to a straight line tl including a center g of the insulating substrate 211.

In the cross section of the ceramic heater 210, of imaginary straight lines which pass through the center g of the cross section and along which a gap between the paired lead portions 217, 217 is measured, an imaginary straight line associated with a minimum gap is defined as a minimum-gap-associated imaginary straight line kl. As measured on the minimum-gap-associated imaginary straight line kl, the gap between the paired lead portions 217, 217 is taken as a, and dimensions of the paired lead portions 217, 217 are taken as b and c, respectively. The gap a (the minimum thickness of a portion 211*m* of the insulating substrate 211 intervening between the lead portions 217, 217) is 1.1 mm (a=1.1 mm). The dimensions b and c of the respective lead portions 217, 217 are both 1.0 mm (b=c=1.0 mm). Portions 211*n*, 211*n* of the insulating substrate 211 which are located radially outward of and cover the respective lead portions 217, 217 have respective thicknesses d and e (as measured on the minimum-gap-associated imaginary straight line kl) of 0.1 mm (d=e=0.1 mm). Therefore, the ceramic heater 210 also satisfies the expression $a \geqq 0.15(b+c)$. The ceramic heater 210 also satisfies the expression $a \leqq D-(b+c)-0.2$.

As mentioned above, also in Embodiment 2, the gap a between the lead portions 217, 217 is increased so as to satisfy the expression $a \geqq 0.15(b+c)$. This lowers stress which is imposed on the portion 211*m* of the insulating substrate 211 intervening between the lead portions 217, 217, in the course of manufacture or use. Therefore, at the interface between each of the lead portions 217, 217 and the portion 211*m* of the insulating substrate 211 intervening between the lead portions 217, 217, a defect, such as generation of a gap therebetween, becomes less likely than in a conventional practice.

Furthermore, the gap a between the lead portions 217, 217 is reduced so as to satisfy the expression $a \leqq D-(b+c)-0.2$. Therefore, the insulating substrate 211 can be such that its portions (211*n*) located radially outward of the respective lead portions 217, 217 each have a thickness of 0.1 mm or greater (in Embodiment 2, 0.1 mm). Therefore, in the course of manufacture or use, at the interfaces between the lead portions 217, 217 and the respective portions 211*n*, 211*n* of the insulating substrate 211 which cover the respective lead portions 217, 217, a defect, such as generation of a gap therebetween, becomes less likely to occur than in a conventional practice.

Other features similar to those of Embodiment 1 described above provide similar actions and effects as do the similar features of Embodiment 1.

While the present invention has been described with reference to above Embodiments 1 and 2, the present invention is not limited thereto, but may be modified as appropriate without departing from the spirit or scope of the invention.

The invention clamed is:

1. A ceramic heater extending in an axial direction and adapted to generate heat from its front end portion upon energization, comprising:

an insulating substrate formed from an insulating ceramic and extending in the axial direction; and a heat-generating resistor formed from a conductive ceramic and embedded in the insulating substrate, wherein the heat-generating resistor includes:

a heat-generating portion embedded in a front end portion of the insulating substrate, having such a form as to extend frontward from a rear side, change direction, and then again extend rearward, and generating heat upon energization, a pair of lead portions connected to respective rear ends of the heat-generating portion and extending rearward in the axial direction, and a pair of lead lead-out portions connected to the respective lead portions, extending radially outward, and exposed outward;

the ceramic heater satisfies an expression $S1 \leqq 0.34Sa$ in any cross section of the ceramic heater which is taken perpendicular to the axial direction and in which the lead portions are present, where:

Sa is a cross-sectional area of the ceramic heater, and

S1 is a total cross-sectional area of the pair of lead portions;

wherein a cross section of the ceramic heater which is taken perpendicular to the axial direction assumes a circular form, an elliptical form, or an oblong form;

in any cross section of the ceramic heater which is taken perpendicular to the axial direction and in which the lead portions are present, of imaginary straight lines which pass through the center of the cross section and along which a gap between the lead portions is measured, an imaginary straight line associated with a minimum gap is defined as a minimum-gap-associated imaginary straight line;

of intersections of the minimum-gap-associated imaginary straight line and an outline of one of the lead portions, an intersection located on a side toward the center is defined as a point A;

of intersections of the minimum-gap-associated imaginary straight line and an outline of the other one of the lead portions, an intersection located on a side toward the center is defined as a point E;

intersections of the outline of the one lead portion and an imaginary circle drawn with the center of the cross section as a center of the imaginary circle and with half of a major diameter of the cross section as a diameter of the imaginary circle are defined as a point B and a point C;

intersections of the outline of the other lead portion and the imaginary circle are defined as a point F and a point G; and an angle $\alpha$ formed by a line segment AB and a line segment AC, and an angle $\beta$ formed by a line segment EF and a line segment EG both range from 160 degrees to 175 degrees.

2. A ceramic heater according to claim 1, satisfying an expression $S1 \leqq 0.25Sa$.

3. A ceramic heater according to claim 1, further satisfying an expression $S1 \geqq 0.15Sa$.

4. A ceramic heater according to claim 1, satisfying an expression $S2 \leqq 0.16Sb$ in at least any cross section of the ceramic heater which is taken perpendicular to the axial direction and in which the heat-generating portion is present, where:

Sb is a cross-sectional area of the ceramic heater, and

S2 is a cross-sectional area of the heat-generating portion.

5. A ceramic heater according to claim 4, further satisfying an expression $S2 \leqq 0.08Sb$.

6. A ceramic heater according to claim 1, wherein an overall length L of the heat-generating resistor along the axial direction is 30 mm or greater.

7. A ceramic heater according to claim 1, wherein the pair of lead lead-out portions are arranged with a gap K of 5 mm or greater therebetween along the axial direction.

8. A ceramic heater according to claim 1, wherein the insulating substrate is formed from a silicon nitride sintered body, and the heat-generating resistor is formed from a silicon-nitride-tungsten-carbide composite sintered body.

9. A ceramic heater according to claim 8, wherein silicon nitride grains contained in the heat-generating resistor have an average grain size of 0.5 μm to 0.8 μm.

10. A ceramic heater according to claim 1, satisfying an expression $a \geqq 0.15(b+c)$ in any cross section of the ceramic heater which is taken perpendicular to the axial direction and in which the lead portions are present where:

of imaginary straight lines which pass through the center of the cross section and along which a gap a between the lead portions is measured, an imaginary straight line associated with a minimum gap a is defined as a minimum-gap-associated imaginary straight line; and b and c are dimensions of the respective lead portions as measured on the minimum-gap-associated imaginary straight line.

11. A ceramic heater according to claim 1, wherein a cross section of the ceramic heater which is taken perpendicular to the axial direction assumes a circular form; and the ceramic heater satisfies $2 \leqq D \leqq 10$ and an expression $a \leqq D-(b+c)-0.2$, where:

D (mm) is a diameter of any cross section of the ceramic heater which is taken perpendicular to the axial direction and in which the lead portions are present;

of imaginary straight lines which pass through the center of the cross section and along which a gap a (mm) between the lead portions is measured, an imaginary straight line associated with a minimum gap a (mm) is defined as a minimum-gap-associated imaginary straight line; and b (mm) and c (mm) are dimensions of the respective lead portions as measured on the minimum-gap-associated imaginary straight line.

12. A ceramic heater according to claim 11, further satisfying an expression $a \geqq 0.15(b+c)$.

13. A glow plug comprising a ceramic heater according to claim 1.

* * * * *